United States Patent [19]

Holland

[11] 4,437,949

[45] Mar. 20, 1984

[54] ELECTROLYSIS OF TIN COMPLEXES

[75] Inventor: Frank S. Holland, Hazel Grove Stockport, England

[73] Assignee: Manchem, Limited, Manchester, England

[21] Appl. No.: 456,317

[22] Filed: Jan. 6, 1983

[30] Foreign Application Priority Data

Jan. 7, 1982 [GB] United Kingdom ..... 8200354

[51] Int. Cl.[3] ..... C25C 5/02

[52] U.S. Cl. ..... 204/59 M; 204/120

[58] Field of Search ..... 204/120, 121, 122, 59 M

[56] References Cited

U.S. PATENT DOCUMENTS

| | | | |
|---|---|---|---|
| 3,347,761 | 10/1967 | Bicek | 204/120 |
| 3,382,163 | 5/1968 | Czaloun | 204/120 |
| 4,052,276 | 10/1977 | Yoshida et al. | 204/120 |
| 4,330,377 | 5/1982 | Franks, Jr. | 204/120 |

FOREIGN PATENT DOCUMENTS

| | | | |
|---|---|---|---|
| 1053996 | 1/1967 | United Kingdom | 260/429 |
| 1115646 | 5/1968 | United Kingdom | 260/429 |
| 1118170 | 6/1968 | United Kingdom | 260/429 |
| 1222642 | 2/1971 | United Kingdom | 260/429 |
| 1276321 | 6/1972 | United Kingdom | 260/429 |
| 1440156 | 6/1976 | United Kingdom | 260/429 |
| 1485196 | 9/1977 | United Kingdom | 260/429 |
| 1548365 | 7/1979 | United Kingdom | 260/429 |
| 1580792 | 12/1980 | United Kingdom | 260/429 |

OTHER PUBLICATIONS

Chemical Abstracts (1980) 137768a.
Chemical Abstracts (1979) 219261y.
Chemical Abstracts (1979) 31005.
Chemical Abstracts (1978) 154572n.
Chemical Abstracts (1978) 137520b.
Chemical Abstracts (1978) 137521c.
Chemical Abstracts (1978) 119596b.
Chemical Abstracts (1978) 119515x.
Chemical Abstracts (1978) 81956d.
Chemical Abstracts (1978) 67408v.
Chemical Abstracts (1978) 144420b.
Chemical Abstracts (1978) 128128q.
Chemical Abstracts (1978) 96562a.
Chemical Abstracts (1978) 13535v.
Chemical Abstracts (1977) 179420n.
Chemical Abstracts (1977) 62604j.
Chemical Abstracts (1976) 127954z.
Chemical Abstracts (1976) 11578a.
Chemical Abstracts (1976) 113402k.
Chemical Abstracts (1975) 67711q.
Chemical Abstracts (1975) 17577e.
Chemical Abstracts (1975) 104762j.
Chemical Abstracts (1975) 66101h.
Chemical Abstracts (1974) 57661t.
Chemical Abstracts (1974) 90333q.
Chemical Abstracts (1974) 9766p.
Chemical Abstracts (1974) 131256w.
Chemical Abstracts (1973) 78962w.
Chemical Abstracts (1972) 28238x.
Chemical Abstracts (1969) 76699w.
Chemical Abstracts (1969) 55994y.
Chemical Abstracts (1969) 88666a.
Chemical Abstracts (1968) 32460r.
Chemical Abstracts (1968) 14906.
Chemical Abstracts (1982) 13940j.
Chemical Abstracts (1978) 63071m.
Chemical Abstracts (1975) 97557m.
Chemical Abstracts (1972) 16885x.
Chemical Abstracts (vol. 50) 88.
Chemical Abstracts (vol. 51) 4847–4848.
Chemical Abstracts (1958) 4360.
Chemical Abstracts (1957) 15218.
Chemical Abstracts (1956) 9184.
Chemical Abstracts (1981) 211829b.
Chemical Abstracts (1981) 194300.
Chemical Abstracts (1981) 38558a.

*Primary Examiner*—R. L. Andrews
*Assistant Examiner*—Terryence Chapman
*Attorney, Agent, or Firm*—Cushman, Darby & Cushman

[57] ABSTRACT

A method and apparatus are described for electrolyzing a tin-containing electrolyte using an electrolysis system having at least two immiscible electrolyte phases and wherein the electric current is passed between electrodes respectively disposed solely in one of the electrolytes. More than two electrolytes may be used.

13 Claims, 8 Drawing Figures

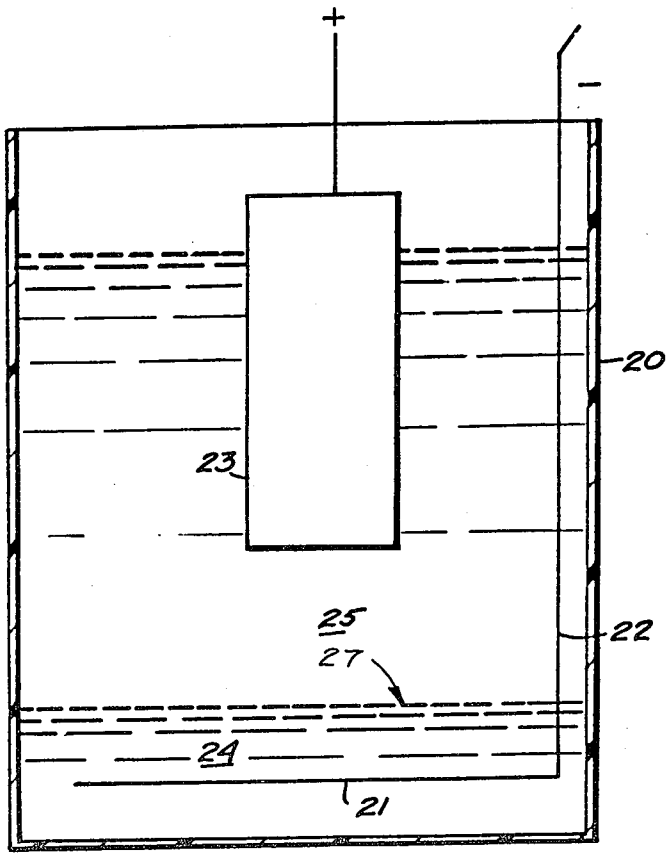
Fig. II
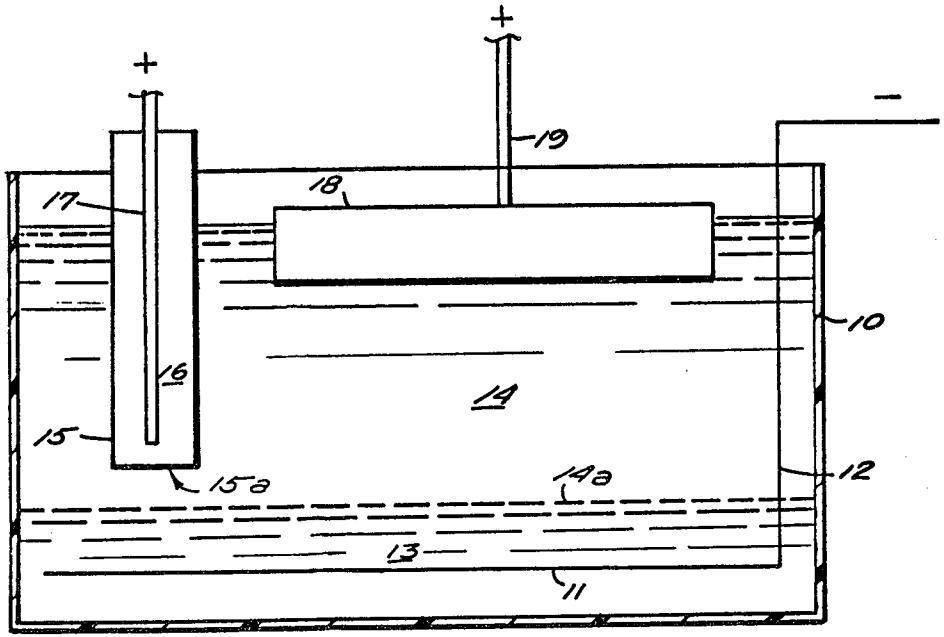
Fig. I

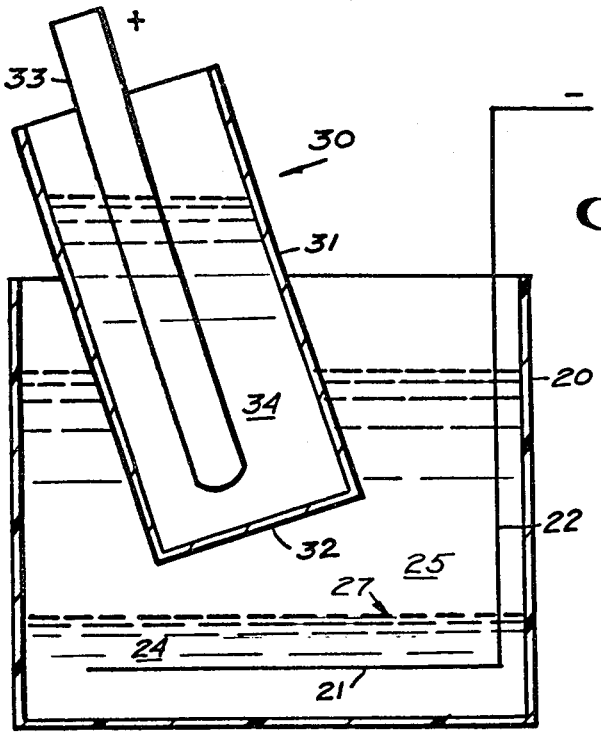
Fig. III
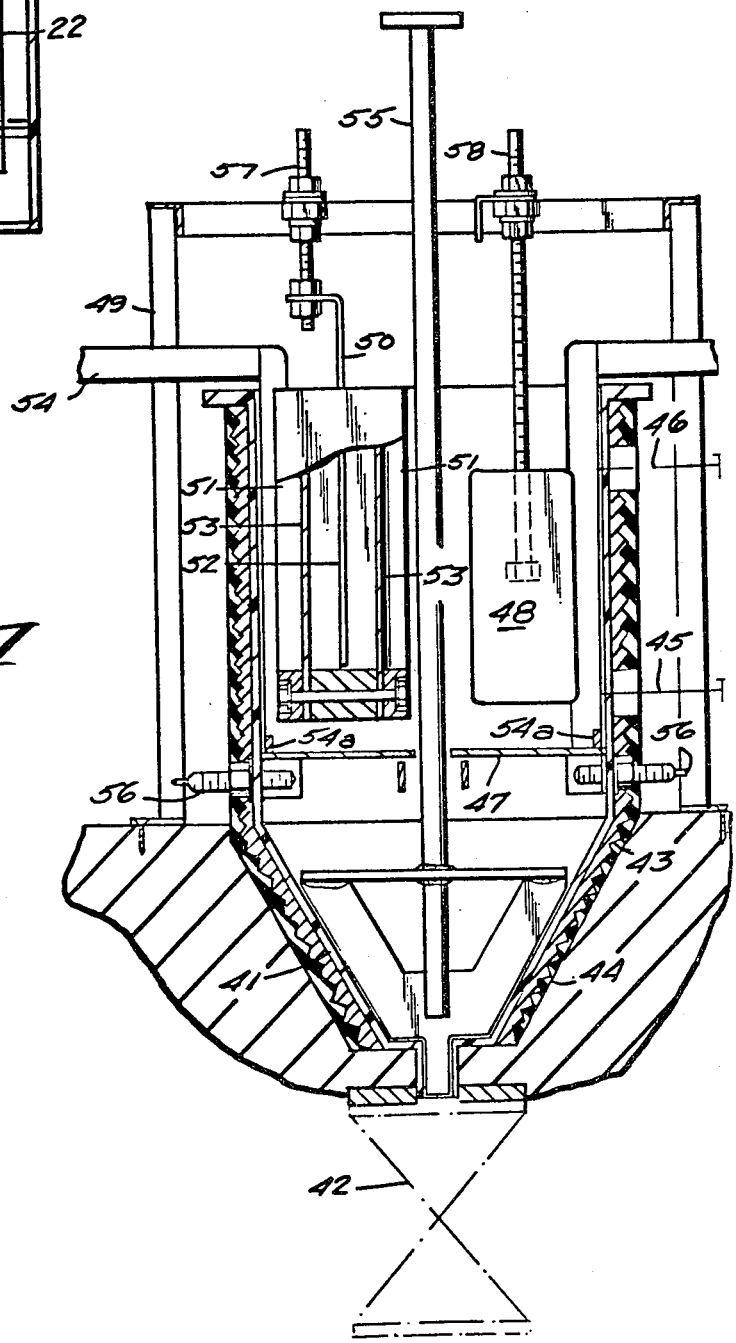
Fig. IV

Fig. V
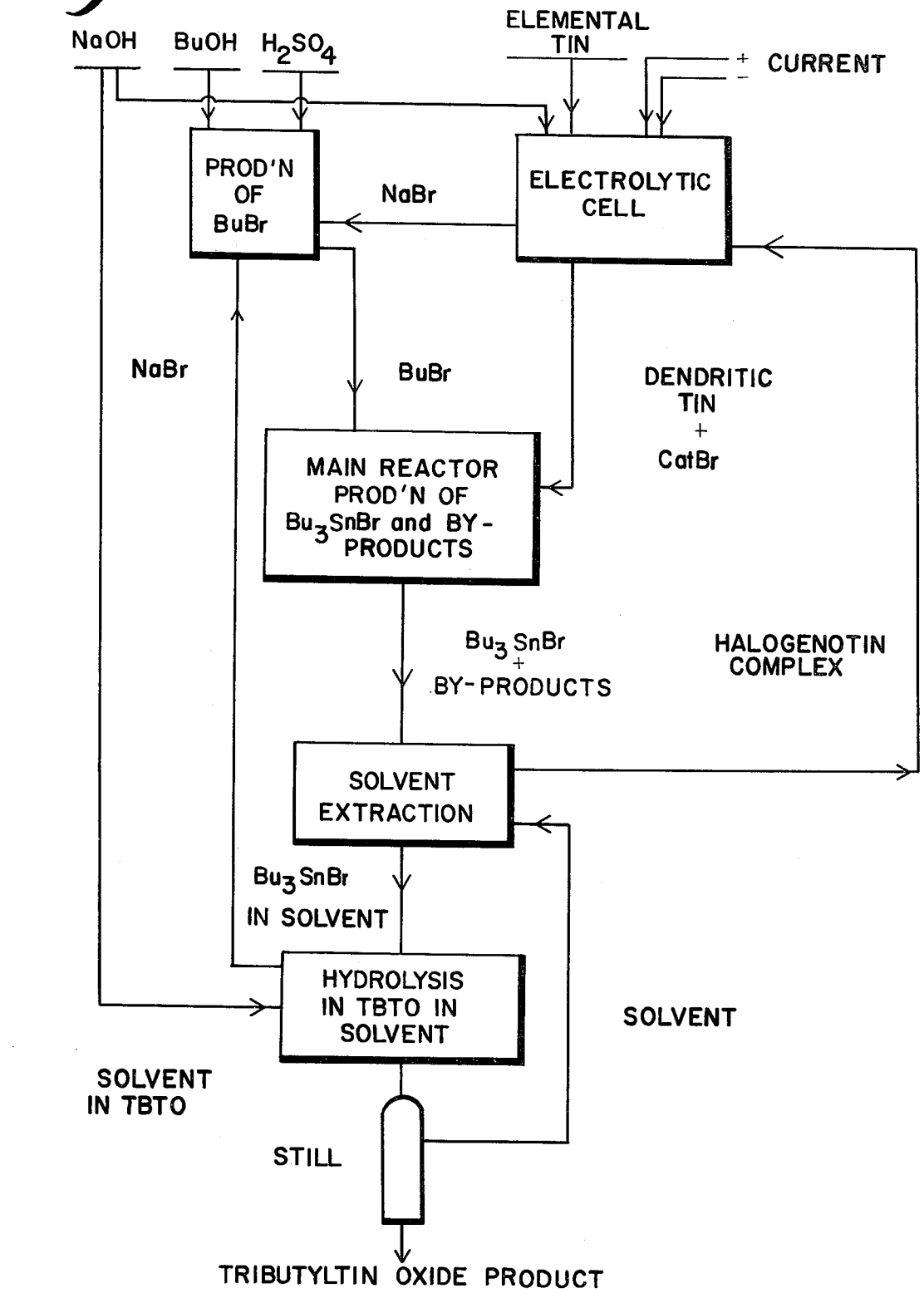

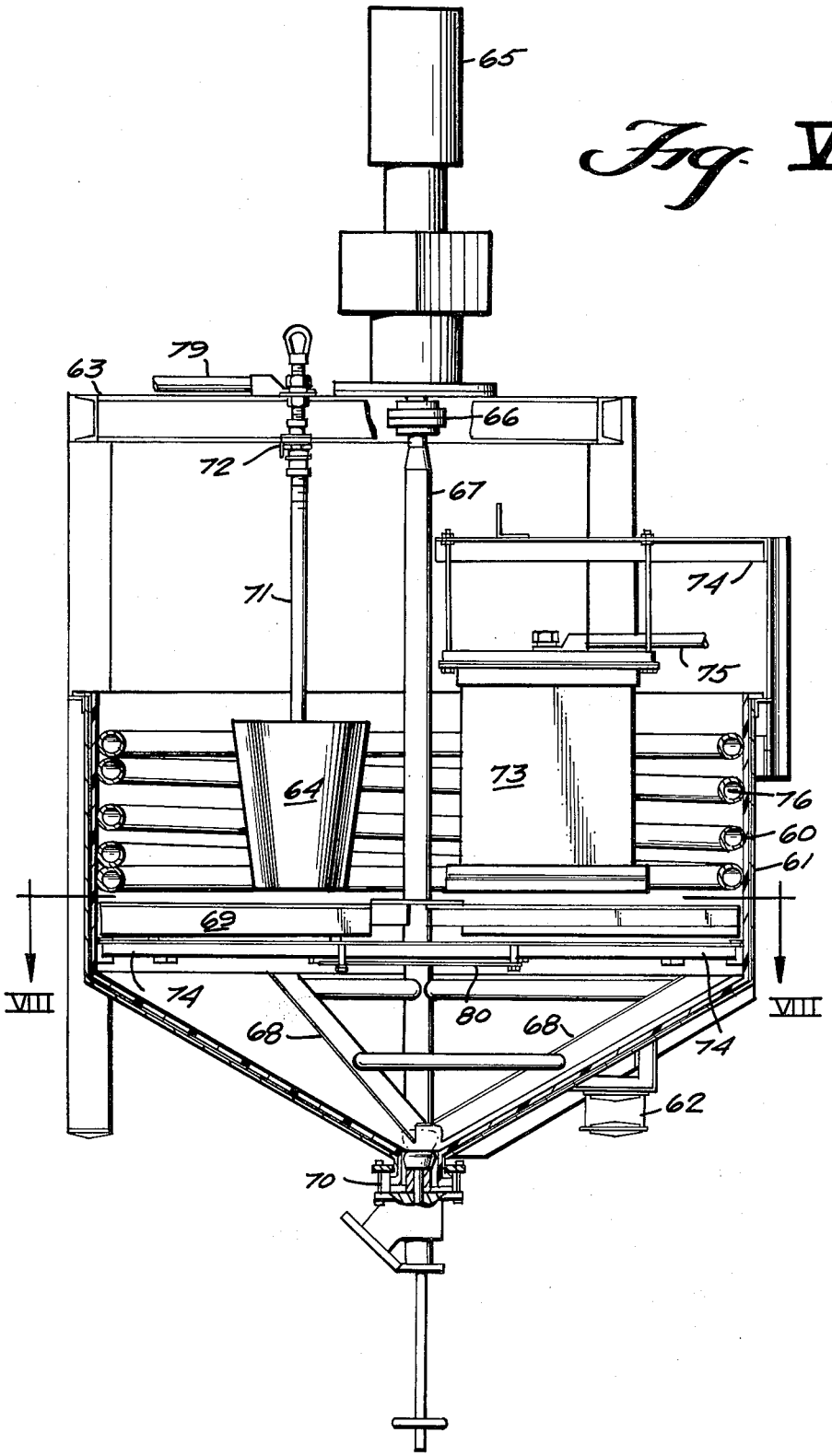
Fig. VI

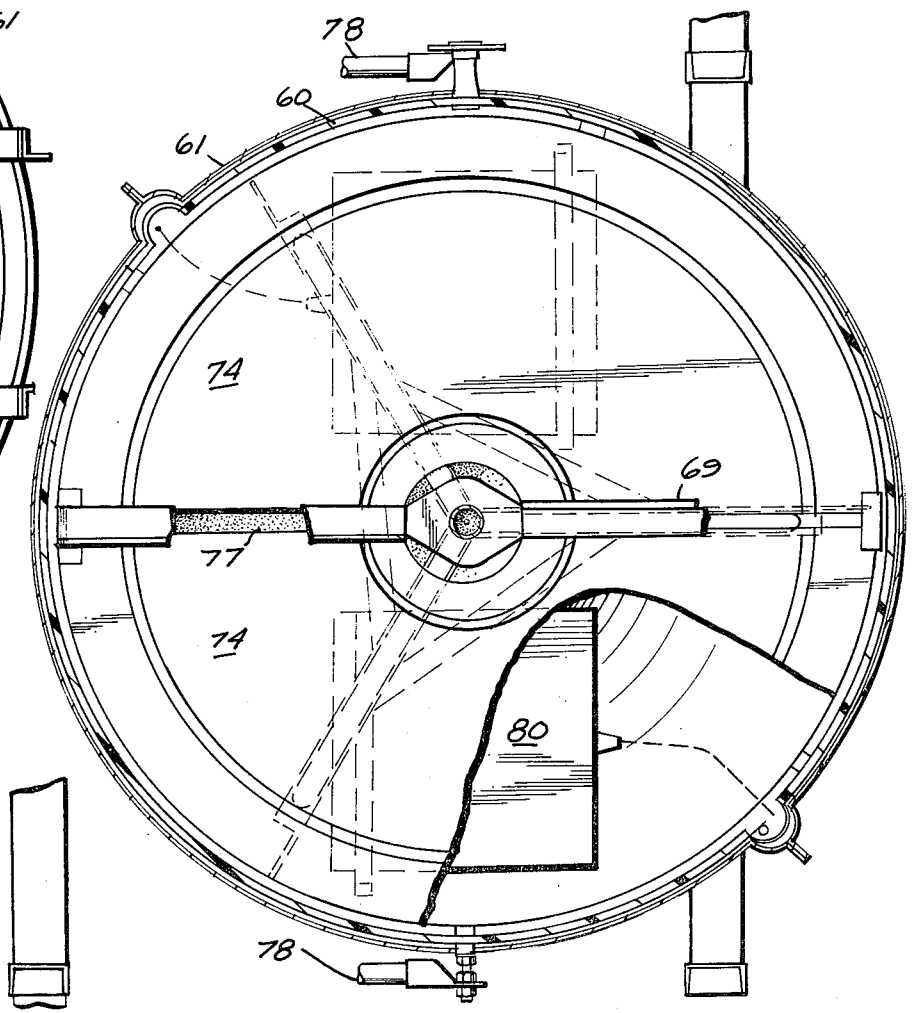
Fig. VIII
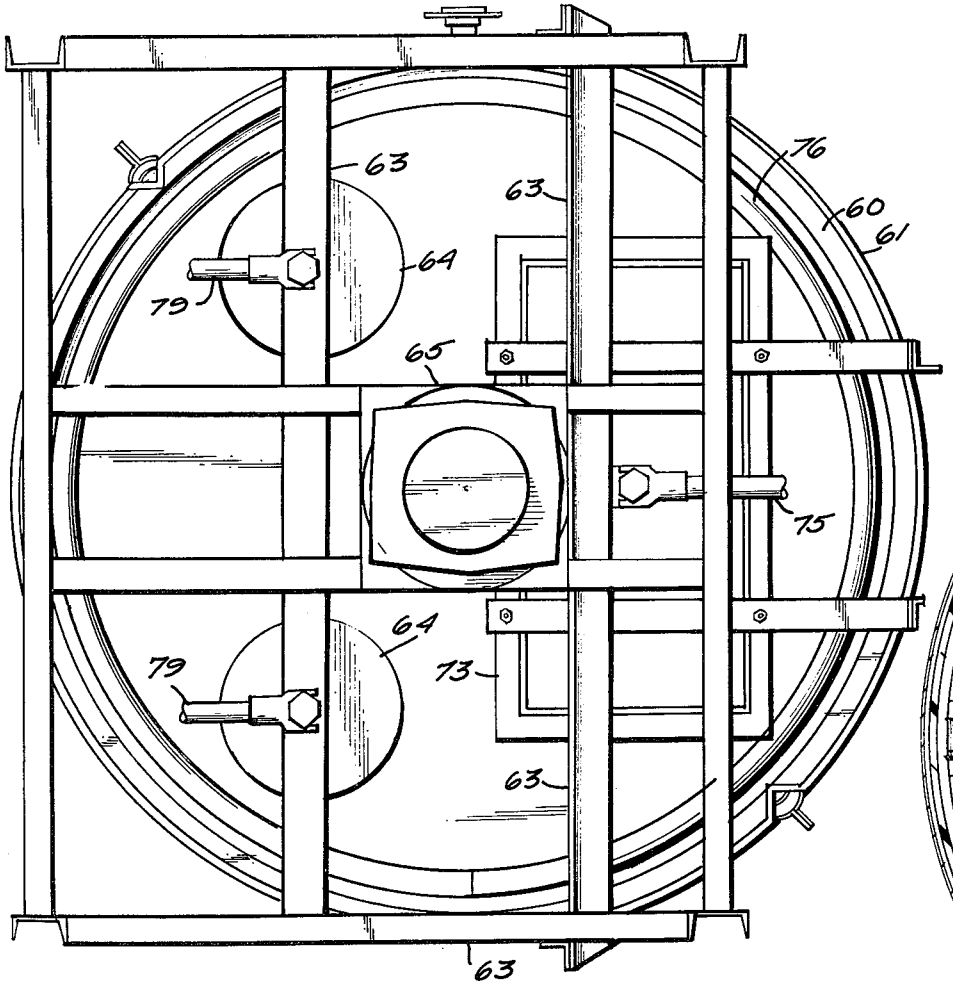
Fig. VII

ELECTROLYSIS OF TIN COMPLEXES

FIELD OF THE INVENTION

This invention provides an electrolytic method of electrolyzing a tin-containing electrolyte, for the formation of elemental tin, and for the production of certain organotin compounds, and an apparatus for the same.

BACKGROUND DISCUSSION

The production of organotin halides by reacting elemental tin with an organic halide in the presence of an 'onium compound catalyst has been described in a number of earlier specifications, for example British patent specifications Nos. 1,115,646, 1,053,996 and 1,222,642. These processes, which lead to an organotin product containing principally diorganotin halides, use the 'onium compound in only catalytic amounts. It is possible that the 'onium compound, for example tetrabutylammonium bromide, forms a halostannite salt with the tin, for example tetrabutylammonium halostannite, and that it is this halostannite salt which serves as the actual catalyst. According to these earlier specifications, such complex formed from the 'onium salt can be recovered and recycled after the organotin products have been separated.

The direct reaction of elemental tin, with an organic halide and comparatively large (reagent) amounts of an 'onium compound leads to an organotin product which consists predominantly of triorganotin halides, as described in our copending application Ser. No. 456,316, filed of even date herewith and entitled "Production of Organotin Halides", the disclosure of which is incorporated herein by reference. For making triorganotin halides, a reagent other than an 'onium compound may be used, for example a complex of an alkali metal ion or alkaline earth metal ion with a polyoxygen compound such as diglyme. The reagent, whether 'onium compound or diglyme complex or some other source of active halide ions that can form a nucleophile with tin species, (i.e., act as a nucleophile generator) can be generally characterized as having the formula $$Cat^+X^-$$

where $Cat^+$ is a positively charged species and $X^-$ is a halogen anion selected from chlorine, bromine and iodine.

The stoichiometry of forming triorganotin halides using reagent amounts of $Cat^+X^-$ may be represented, for the case where tetrabutylammonium bromide is $Cat^+X^-$ and butyl bromide is the organic halide thus (wherein Bu represents butyl):

$$2\ Sn + 3\ BuBr + Bu_4NBr \rightarrow Bu_3SnBr + Bu_4NSnBr_3.$$

When reagent amounts of 'onium compound or alternative reagent are used, substantial quantities of a complex containing the tin, combined with or complexed with the $Cat^+X^-$, are formed; but whether this complex is exactly the halostannite salt indicated by the above equation is not certain. Whatever the complex is, it is formed in large quantities.

In order to re-use the tin (and possibly other metals) and reagent contained in such complex, it is again desirable to treat the same for recovery of the tin and reagent as such.

The complex formed as a by-product in the direct reaction of tin with an organic halide in the presence of an 'onium compound or other compound of formula $Cat^+X^-$ is itself water insoluble. It is also insoluble in hydrocarbons, and this feature makes it possible to separate it from the hydrocarbon-soluble organotin halides by solvent extraction.

The single phase electrolyses of complexes of a similar nature, but involving indium, beryllium, zinc and tin are described in German patent No. 1,236,208. This reference describes a process for producing very pure metals on the cathode therein from less pure metals as anode. However, the resistivity of the electrolyte is discouragingly high (about 50 ohm-cm), and, therefore, the electrolysis must be operated at low and economically unattractive current densities (e.g., 6 mA/cm$^2$).

A type of two-phase electrolysis system is described in U.K. No. 1,092,254. This system involves the electrolysis of an aqueous electrolyte in contact with a material of low electrical conductivity (typically $10^{-20}$ to $10^{-4}$ reciprocal ohms per centimeter) and substantial insolubility. One electrode is in contact with only the aqueous solution, whereas the other electrode is partially immersed in both phases. It is claimed that sufficient non-aqueous phase wets the latter electrode to be involved in the electrolysis, but the examples indicate that, again, only discouragingly low current densities can be achieved (27–75 mA/cm$^2$).

SUMMARY DESCRIPTION OF INVENTION

According to the present invention there is provided a method of electrolyzing a tin-containing electrolyte, wherein an electric current is passed between an anode disposed solely in an aqueous anolyte and a cathode located solely in an aqueous-electrolyte immiscible catholyte comprising a halogenotin complex, there being a liquid-liquid interface between an aqueous electrolyte (either the anolyte or, in other embodiments, an intermediate aqueous electrolyte) and the aqueous electrolyte-immiscible catholyte, with the cathode not being in contact with the anolyte (or the intermediate aqueous electrolyte). The electrical current is transferred electrolytically between the phases.

The method of this invention includes the recovery of tin and of an 'onium compound of the general formula $Cat^+X^-$ from a water-insoluble halogenotin $Cat^+$ complex, containing the same in combined form, such as has been formed in the production of organotin halides by the direct reaction of tin and an organic halide in the presence of said compound, and which comprises utilizing an at least two-phase electrolyte system and passing an electric current between an anode located in an aqueous phase anolyte and a cathode located in a water-insoluble phase of said $Cat^+$ halogenotin complex as catholyte with at least one liquid-liquid interfacial contact surface between said catholyte and an aqueous electrolyte.

The electrical current is transferred electrolytically between the phases.

This method is particularly suitable when the said halogenotin complex has been formed in the production of triorganotin halides by the direct reaction of tin with an organic halide and with a reagent amount of said $Cat^+X^-$ compound, using at least one mole of 'onium compound per 5 moles of said organic halide, and especially one mole of said compound per at most about 4 moles of organic halide.

The tin in the halogenotin complex can be in its 2 or 4, and possibly in its 3, valence state. Generally, therefore, the halogenotin complex may have the empirical formula:

$$Cat_dSn_eX_f$$

where
d is 1 or 2
e is 1 or 2
f is 3 to 6

However, since these complexes can be the by-products from the preparation of organotins, these organotins and partially substituted tins may also be present, such as for example $Bu_4N^+BuSnBr_4^-$ and $Oct_4N^+Bu_2SnBr_3^-$ (Oct=octyl).

Further, since the tin (2) species can absorb oxygen, oxygen compounds may also be present.

In a further embodiment the invention provides electrolytic apparatus comprising (a) an anode disposed solely in an aqueous anolyte, and (b) a cathode immersed in an aqueous electrolyte-immiscible catholyte comprising a halogenotin complex, there being a liquid-liquid interface between the aqueous anolyte or an optional intermediate aqueous electrolyte and the aqueous electrolyte-immiscible catholyte and the cathode not being in contact with the anolyte or intermediate aqueous electrolyte.

In a yet further embodiment of the invention, an apparatus is provided in which two or more separate anodes are employed, with at least one such anode located in a second aqueous anolyte separated from the first anolyte by an ion exchange membrane, as is more fully described hereinafter.

We have now found in the present invention that the electrolysis of an aqueous electrolyte in contact with the catholyte with the anode or anodes in the aqueous phase and in contact only with the aqueous phase, and with a cathode in contact only with the non-aqueous immiscible catholyte phase, can be operated at attractively high and economical current densities at relatively low voltage, e.g., up to 2 $KA/M^2$ (200 $mA/cm^2$) at 10–15 volts, and surprisingly so despite the fact that the conductivity of the catholyte is itself low.

In the accompanying drawings,

FIG. I schematically illustrates a three-electrode, three-phase electrolysis cell, used in this invention;

FIG. II schematically illustrates a two-electrode, two-phase electrolysis cell;

FIG. III schematically illustrates a two-anode, three phase electrolysis cell; and FIGS. IV and VI–VIII illustrate plant embodiments of an electrolysis cell (see descriptions in Example 5 and following Comparative Example B); and FIG. V illustrates a flow sheet of one practical embodiment of the practice of this invention in combination with a direct reaction between elemental tin and organohalide to produce, ultimately, bis (triorganotin) oxide.

DETAILED DESCRIPTION OF THE INVENTION

In one embodiment of the method of this invention, the anolyte may be an aqueous solution phase of an alkali metal halide. The anode in electrical contact with this anolyte can be any suitable non-corrodible anode such as platinum or graphite. The catholyte is a halogenotin complex with $Cat^+$. Passage of electric current between the anode and a cathode located in the catholyte breaks down the catholyte into tin, which is then deposited as dendrites on the cathode, and the 'onium compound of formula $Cat^+X^-$, which remains with the water-insoluble, low conductivity liquid.

Such a system is illustrated in FIG. II wherein the cell 20 contains a cathode 21, connected to an insulated feeder line 22, and a non-corrodible anode 23. Cathode feeder line 22 and anode feeder line 26 are connected to a suitable source of direct current electricity, not shown. Two immiscible liquid phases 24 and 25 are located in the cell 20. The lower liquid catholyte phase 24 comprises the halogenotin complex; the upper phase 25 is an aqueous anolyte solution, e.g., an alkali metal or alkaline earth metal halide. The lower catholyte phase 24 entirely covers cathode 21 so that the latter is not in contact with anolyte upper phase 25. Similarly, anode 23 is only in contact with the aqueous anolyte phase 25. The anolyte and catholyte are in contact at the liquid-liquid interface 27.

Alternatively, the anolyte may be an aqueous electrolyte solution of, e.g., an alkali metal hydroxide separated by a cation exchange membrane from an intermediate electrolyte of aqueous alkali metal halide, with a non-corrodible anode such as stainless steel or nickel in electrical contact with said first anolyte. This arrangement provides a three-phase electrolysis system.

It is thus possible to arrange for electrolysis of the halogenotin complex in the apparatus shown in FIG. III. In this arrangement, cell 20 is equipped with (non-corrodible) cathode 21 connected to insulated feeder 22. The cell contains a lower water-immiscible phase of the complex, 24, which entirely covers the cathode 21. An aqueous salt phase 25 floats on top of the catholyte phase 24, with the liquid-liquid interface 27 forming the contact therebetween. Extending into the salt phase 25 is chamber 30, with at least a portion of the immersed walls 31 thereof being formed of an ion exchange membrane 32. Chamber 30 contains an anolyte 34, e.g., alkali metal hydroxide aqueous solution, and extending therein is (non-corrodible) anode 33. Operation of this system is described in Example 3, hereinafter.

When this three-phase electrolyte system is used, tin from the by-product complex compound(s) is deposited on the cathode. In addition, more alkali metal halide is formed in the intermediate electrolyte (with alkali metal ion derived from the anolyte and halide ion from the catholyte by-product). The alkali metal halide formed in this way may be recovered for further use, e.g., the recovered alkali metal halide may be reacted with an alcohol and mineral acid to form an organic halide which can then be used in the production of organotin halides.

Additionally, a tin anode, immersed in the alkali metal halide intermediate electrolyte, can be used in addition to the non-corrodible anode, and extra tin may thereby be deposited on the cathode. Thus, a mixture of $Cat^+X^-$, containing tin from and mixed with the halogenotin complex, and enriched in tin derived from the tin anode is obtained. Such an enriched product is ready for use in the aforesaid direct reaction.

Such a system is schematically illustrated in FIG. I herewith, wherein the cell 10 has a cathode 11 connected to an insulated feeder 12. The water-immiscible catholyte liquid phase 13 fully covers cathode 11, and lying on top is the aqueous salt solution intermediate electrolyte 14, in contact with the catholyte at liquid-liquid interface **14*a*. Chamber 15 has at least a wall member portion, e.g., 15*a*, formed of an ion exchange membrane. Non-corrodible anode 17 is immersed in a second anolyte 16, e.g., an aqueous alkali metal solution within chamber 15. Corrodible tin anode 18 is at least partially immersed in the intermediate anolyte 14, and connected by feeder 19** to a D.C. current supply, not shown. An embodiment of the operation of this system is given in, e.g. Example 2, hereinafter.

If a tin anode is used alone, without the separate non-corrodible anode, there is obtained a mixture of dendritic tin and non-electrolysed by-product. By reaction of this mixture with an organic halide (RX) there can be obtained a high yield of diorganotin dihalide ($R_2SnX_2$), together with halogenotin complex depleted of tin metal. Such a system is illustrated in FIG. II.

Likewise, if the halogenotin complex contains a metal other than tin, electrolysis using the three-phase, non-corrodible anode will produce dendrites containing that metal. Alternatively, a corrodible tin alloy anode only may be used, as described above, to give a mixed product containing both the tin and the alloy metal. Further, a second corrodible metal anode (other than tin) can be used to give a product containing both tin and that second metal.

Suitable second metals in such alloy, or as a second corrodible anode, include cobalt, nickel, copper, manganese, iron, zinc and silver.

It is convenient to set up the cell system so that the anolyte or intermediate aqueous electrolyte is merely floating on the catholyte; if desired, however, the two or three phases of the electrolyte system need not be in superposed relationship, and can be separated by a suitable ion-permeable physical barrier, such as a filter cloth, still providing an effective liquid-liquid interface.

Discussion of the Electrolytic Reactions

The compound of formula $Cat^+X^-$ which is either present as such or in combined form in the materials treated according to this invention may have either a quaternary or ternary positively-charged group, as $Cat^+$. Thus, $Cat^+$ may be of general formula $$R_zQ^+$$

wherein each R group is independently an organic group, Q may be N, P, As or Sb, in which case z is 4, or Q may be S or Se in which case z is 3. The organic group is normally a hydrocarbyl group containing up to 20 carbon atoms selected from alkyl, aralkyl, cycloalkyl, aryl, alkenyl and analkenyl. Inert substituents may of course also be in the group represented by R. Alternatively $Cat^+$ may be a complex of an alkali metal ion or alkaline earth metal ion with a poly-oxygen compound such as diglyme, a polyoxyalkylene glycol or glycol ether, or a crown ether.

The tin and the $Cat^+X^-$, and optionally the halide ion after its conversion to alkali metal halide, as obtained by the process of this invention, are preferably recycled in combination with a process for the manufacture of organotin halides by the direct reaction of tin, organic halide (RX) and $Cat^+X^-$. Thus, there can be built up a cyclic process consisting of said direct reaction (between Sn and RX), separation of by-product (e.g., by solvent extraction) from the desired organotin product, electrolysis of such by-product, and recycle of electrolysis products back to the direct reaction. For this cyclic process the only feeds to the system need be make-up tin (to replace that withdrawn as organotin) and perhaps organic halide. The organotin halide product can itself be converted further to organotin oxide, such as bis (tributyl tin) oxide (TBTO), thus liberating halide ion which, after alkylation with an alcohol, can be supplied as feed RX to the aforesaid direct reaction.

Such a combination of interrelated process steps is illustrated in FIG. V herewith.

In the electrolysis cell process the current appears to be transferred electrolytically, i.e., by the direct transfer of ions between the adjacent immiscible phases, with the tin metal being produced at the cathode which is in contact with the halogenotin complex. This has many advantages, the first being the surprisingly high current densities achievable, despite the fact that the complex itself is of relatively low conductivity. A further advantage is that the composition of the aqueous phase can be chosen to be very different from that of the non aqueous phase. For example, the aqueous electrolyte can be a cheap simple salt such as sodium chloride or sodium bromide, whereas the non-aqueous electrolyte might be an expensive material, such as the by-product from organotin manufacture containing for example, 'onium ions and halogenotin complex anions.

In the case of sodium chloride or sodium bromide as the aqueous electrolyte, electrolysis with a non-corrodible anode such as platinum, would produce chlorine or bromine as a valuable cell product. If, however, tin is used as a corrodible anode in this system, electrolysis would produce dendritic tin at the cathode in contact with the halogenotin complex. In this case, the tin anode in the aqueous phase corrodes to produce tin ions which are transferred across the boundary of the two phases and deposited onto the cathode as tin metal.

A further advantage of this transfer of ions between the phases is that the transfer can be used to balance the ions in either phase. Thus for example, if the electrolysis system is:

(a) a platinum anode in aqueous sodium bromide solution, and (b) a stainless steel cathode in tetrabutyl ammonium bromostannite ($Bu_4N^+SnBr_3^-$)

then electrolysis would proceed as follows:

Anode reaction:

$$2\,Br^- \rightarrow Br_2$$

Cathode reaction:

$$Bu_4N^+SnBr_3 \rightarrow Bu_4N^+Br^- + Sn^\circ + 2Br^-$$

Therefore, the aqueous phase would become depleted in bromide ions and the non-aqueous phase would gain an excess of bromide ions. However, the bromide ions are transferred between the phases so that each phase is electrolytically balanced.

The overall reaction is:

$$Bu_4N^+SnBr_3^- \rightarrow Bu_4N^+Br^- + Sn^\circ + Br_2$$

In this case, the halogenotin complex of the non-aqueous phase is substantially altered by the electrolysis process. Thus, the processes occurring appear to be similar to ion exchange, with the non-aqueous phase acting as a liquid ion exchanger.

A further advantage of this two-phase electrolysis of halogeno tin complexes is that either a single anode may be used in the aqueous phase or a plurality of anodes may be used.

A single anode system has just been exemplified.

A double anode system can also be exemplified by a tin anode and a platinum anode, both dipping into an aqueous solution of sodium bromide as one phase, which is, in turn, in contact with an insoluble halogenotin complex as the second phase, in which latter phase there is a suitable conducting cathode such as stainless steel. Electrolysis causes the corrosion of tin from the anode into the aqueous phase, the transfer of tin ions across the interphase boundary, and the deposition of elemental tin on the cathode.

Electrolysis also causes the evolution of bromine at the platinum anode, the decomposition of the halogenotin complex in the non-aqueous phase and the transfer of bromide ions across the boundary from the non-aqueous phase into the aqueous phase. Thus, the halogenotin complex is now substantially altered by the electrolysis process. This electrolysis can be summarized by:

(a) Anode reactions:

$$Sn \rightarrow Sn^{2+} \text{ (or } SnBr_3^-)$$

$$2\ Br^- \rightarrow Br_2$$

(b) Cathode reactions: (in the case where the halogenotin complex is $Bu_4N^+SnBr_3^-$)

$$Bu_4N^+SnBr_3^- \rightarrow Bu_4N^+Br^- + Sn^\circ + 2Br^-$$

(c) The current carrying processes are:

(i) transfer of 2 $Br^-$ from the $Bu_4N^+SnBr_3^-$ phase to the aqueous phase.

(ii) transfer of tin ions from the aqueous phase to the non-aqueous phase.

Thus, the overall reaction, requiring 4 Faradays of electricity, is:

$$Sn\ (anode) + Bu_4N^+SnBr_3^- \rightarrow 2\ Sn^\circ\ (cathode) + Bu_4N^+Br^- + Br_2$$

A further example of a double anode system is exemplified by a tin anode dipping into an aqueous salt solution of e.g., sodium bromide. Also dipping into the sodium bromide solution is a separate container made of non-conducting walls containing an aqueous electrolyte solution conveniently sodium hydroxide. The said container is fabricated so that the sodium hydroxide solution is physically separated from the sodium bromide solution by an ion exchange membrane which will, however, allow the passage of ions but not the free mixing of the respective aqueous solutions. (Such systems are shown in FIGS. I, III and IV).

Extending into the sodium hydroxide solution is the second anode, e.g., of nickel. The sodium bromide solution is thus in interface contact with the insoluble halogenotine complex, as a separate immiscible phase, within which there is a metal cathode. Electrolysis in this three-electrolyte phases cell brings about the following reactions:

(a) Anode reaction in sodium hydroxide solution:

$$2\ OH^- \rightarrow 0.5\ O_2 + H_2O \text{ (2 Faradays)}$$

(b) Anode reaction at tin anode:

$$Sn \rightarrow Sn^{++} \text{ (or } SnBr_3^-) \text{ (2 Faradays)}$$

(c) Cathode reactions (in the case where the halogenotin complex is $Bu_4N^+SnBr_3^-$)

$$SnBr_3^- \rightarrow Sn^\circ + 3\ Br^- \text{ (2 Faradays)}$$

$$Bu_4N^+SnBr_3^- \rightarrow Bu_4N^+Br^- + Sn^\circ + 2\ Br^- \text{ (2 Faradays)}$$

(d) The current carrying processes are:

(i) 2 $Na^+$ transferred from sodium hydroxide solution through the membrane to the sodium bromide solution.

(ii) 2 $Br^-$ transferred from $Bu_4N^+SnBr_3^-$ phase to the sodium bromide solution (thus forming 2 $Na^+Br^-$).

(iii) $SnBr_3^-$ transferred from the aqueous phase into the non-aqueous phase.

(iv) 3 $Br^-$ transferred from the non-aqueous to the aqueous phase.

Thus, the overall reaction, requiring 4 Faradays of electricity, is:

$$Sn\ (anode) + 2NaOH + Bu_4N^+SnBr_3^- \rightarrow 2\ Sn\ (cathode) + Bu_4N^+Br^- + 2\ NaBr + 0.5\ O_2 + H_2O.$$

It will be observed that 2 Faradays of electricity corrode tin from the tin anode and deposit tin on the cathode located in the non-aqueous phase but causing no change to that phase; whereas the other 2 Faradays of electricity decompose sodium hydroxide to oxygen and decompose the halogenotin complex, e.g., $Bu_4N^+SnBr_3$, into tin, the onium compound $Cat^+X^-$, e.g., $Bu_4N^+Br^-$, and the halide ions, which latter are transferred to the aqueous phase.

It is a further feature of this invention that these two anode, two- or three-phase systems can be adjusted to give whatever final mixture of cathode products is required. The adjustment is made by altering the ratio of currents passing through the tin anode and the other, non-corrodible anode. For this embodiment of the invention, the electrolysis cell is equipped with any suitable electrical current adjusting means to deliver desired current levels to respective electrodes.

For example, in the last two anode systems described above, both anodes carried equal currents, 2 Faradays each, and therefore the final cathode product has 2 Sn for each $Bu_4NBr$ (which is held in the non-aqueous phase of the unaltered halogenotin complex). That is, the ratio of tin to 'onium compound, e.g., $Cat^+X^-$, is 2 to 1. Now such a mixture of at least 2 Sn and $Cat^+X^-$ can be reacted, in accordance with a further invention of ours as described in our copending application entitled "Production of Organotin Halides" (the disclosure of which is incorporated herein by reference), with 3 alkyl halides (for example) to give, substantially, the triorganotin compounds. Thus, the cathode product from the electrolysis described above, could be taken from the cell and treated with 3 moles of alkyl halide per mole of onium compound and thus would produce the triorganotin compound ($R_3SnX$).

Alternatively, if instead of equal amounts of current, the ratio was adjusted so that twice as much current was carried by the tin anode than by the other anode, then the ratio of tin to $Cat^+X^-$ in the final cathode product would be 3 to 1. Reaction of this mixture with 5 moles of alkyl halide per mole of $Cat^+X^-$ would produce an equimolar mixture of triorganotin compound and diorganotin compound, e.g.

$$3\ Sn + Cat^+X^- + 5\ RX \rightarrow R_3SnX + R_2SnX_2 + Cat^+SnX_3^-$$

(where the $Cat^+SnX_3^-$ represents the halogenotin complex by-product which can be recycled to the electrolysis cell).

At one limit, if the other (non-corrodible) anode does not carry *any* current, then the system reverts to a single anode two-phase electrolysis. In this case, the halogenotin catholyte simply becomes loaded with tin (principally as tin dendrites) and this material may be reacted (outside the cell) with RX to give predominantly the diorganotin compounds, i.e., $$Sn^\circ + 2\ RX \rightarrow R_2SnX_2$$

(this reaction is catalysed by the halogenotin complex), as well as some mono-organotin trihalide ($RSnX_3$).

Alternatively, at the opposite limit, if the tin anode carries no current, then the system also becomes a single anode two-phase electrolysis. However, in this case, the halogenotin catholyte would be partially or even totally decomposed to give tin and the 'onium compound ($Cat^+X^-$) in equimolar amounts, i.e., in the molar ratio of 1 to 1. This last product could be used for reaction (outside the cell) with additional tin (e.g., powder or granulated) and alkyl halide to give predominantly triorganotin compounds.

A still further example of a double anode system may use a corrodible anode as the second anode. Thus, such a system could have both a tin anode and, for example, a zinc anode dipping into an aqueous halide ion electrolyte as one phase, which is in turn in contact with a halogenotin by-product from the preparation of organotins as the second phase, in which latter phase there is a metal cathode. Electrolysis causes the corrosion of the tin to give tin ions and of the zinc to give zinc ions. Both of these ions are transferred across the two-phase boundary to be deposited together on the cathode as elemental tin and elemental zinc.

If the ratio of the anode currents is adjusted so that twice as much zinc as tin is corroded and plated, then the cathode product will have a tin to zinc ratio of 1 to 2. Reaction of this cathode product (outside the electrolytic cell) with RX will give predominantly the tetraorganotin, i.e.

$$Sn^\circ + 2\ Zn^\circ + 4\ RX \rightarrow R_4Sn + 2\ ZnX_2$$

(this reaction also being catalyzed by the halogenotin complex).

In still a further embodiment, a three-anode system can be established having, for example, a tin anode, a zinc anode and a third non-corrodible anode (possibly in a separate, membraned, compartment). By adjusting the respective currents through each anode a final cathode product containing a chosen, pre-determined ratio of tin: zinc: $Cat^+X^-$ would be obtained. Reaction of this cathode product with alkyl halide (outside the cell) can then produce a pre-selected mixture of, e.g., triorganotin and tetraorganotin.

Thus, an important embodiment feature of this invention is that by the choice of anodes and the adjustment of the ratio of currents passing through the anodes, a cathode product can be obtained which can be reacted outside the cell with (for example) an alkyl halide to give a desired mixture of organotins ranging from predominantly diorganotin compounds (containing some mono-organotin compound), through predominantly triorganotins, and up to predominantly tetraorganotins.

A still further feature of this invention is that the anode reaction products and the products produced in the aqueous electrolyte can also be used. Thus, for example, in the case where the second anode reaction is halogen formation (e.g., $Br_2$, $Cl_2$) then the halogen can be used outside the cell. For example, chlorine could be used for stripping tin from waste tin plate so helping to provide a source of tin for the electrolytic deposition of tin in the two-phase system. In particular, the sodium halide (e.g., bromide) produced in the aqueous electrolyte can be used to halogenate an alcohol for subsequent conversion, with the cathode product, to organotin compound.

It will also be apparent that in addition to the process aspects, this invention also provides a novel electrolytic cell apparatus and structure particularly as shown schematically in FIG. I, and in more detail in FIG. IV, and as a further embodiment in FIGS. VI, VII and VIII (the latter being described hereinafter). In the apparatus aspect of this invention, an electrolysis cell is provided having means to support a plurality of electrodes, means to supply current to the respective electrodes independently of each other, with means to separately control the current densities delivered to each such electrode, and wherein at least one of said electrodes is corrodible, and particularly wherein at least one (non-corrodible) electrode is disposed in contact with an anolyte contained within a chamber separated from a second anolyte by a wall member composed at least in part of an ion exchange membrane. Means are also provided to contain two immiscible liquid media having a liquid-liquid interface therebetween, with the cathode(s) arranged to be entirely located in the lower, water-immiscible, liquid phase, with the means for delivering current to such cathode being electrically insulated and out of electrical contact with the aqueous anolyte(s) phase. Further features of the apparatus include means for adjustibly raising and lowering at least one of the corrodible anodes, and means for separately withdrawing from the electrolytic cell the water-immiscible catholyte phase and the aqueous anolyte phase. Desirably also the electrolysis cell includes means for mechanically removing from the cathode metal deposits (particularly dendritic metal) formed thereon during the course of the electrolytic process, and for removing the same, from time to time as desired, from the electrolytic cell.

This invention will now be further described in the following examples, which begin with an example of the so-called direct reaction to produce organotin halides as main product and a (incompletely identified) liquid as halogenotin complex by-product, which liquid is then the starting material for the further electrolysis examples of this invention. (All temperatures are in degrees Centigrade.)

Preparation of starting material

Dendritic tin was first prepared by the electrolysis of an aqueous solution of sodium bromide (10–15%) containing $SnBr_2$ (10–20 g/l Sn) in a 25 liter polypropylene tank using a tin anode and a stainless steel rod as cathode (area about 40 $cm^2$). This cell was operated at 50°–70° and 30 to 100 Amps. The dendritic tin was removed periodically from the cathode and the cell, washed and dried. The dried product (a fluffy interlocked mass of dendrites) had a low bulk density—between 0.2 and 0.5 g per cc.

Dendritic tin thus produced was next reacted with tetrabutylammonium bromide ($Bu_4N^+Br^-$) and butyl bromide (BuBr) in a 2 liter round-bottom flask fitted with a condenser, thermometer, and dropping funnel with its outlet extended below the level of the reaction mass in the flask.

The $Bu_4N^+Br^-$ and some of the dendritic tin (usually about 50% of the charge) were loaded into the flask and heat applied to melt the $Bu_4N^+Br^-$ and to maintain the temperature throughout the reaction. Butyl bromide was added from the dropping funnel at such a rate as to maintain the reaction temperature. As the dendritic tin was consumed, the rest of the tin charge was added.

This reaction was effected 17 times using different amounts of the reagents or different reaction conditions each time.

The quantities involved and the reaction conditions are set out for each of the experiments in the following Table I. At the end of the reaction the flask contained a liquid mixture of reaction products and residual tin, and the liquid mixture was decanted off the tin. The liquid mixture was extracted with hydrocarbon (b.p. 145°-160°) at 80° three times using the same volume of hydrocarbon as of liquid mixture each time. The residue, insoluble in hydrocarbon, was a yellow-khaki by-product which was the water-insoluble $Bu_4N^+$ bromotin complex by-product, and which can now be treated electrolytically for recovery of tin and $Bu_4N^+Br^-$, (i.e., the nucleophile generator). The three hydrocarbon extracts were distilled to remove hydrocarbon and leave a product mixture which contained dibutyltin dibromide ($Bu_2SnBr_2$) and tributyltin bromide ($Bu_3SnBr$) in the respective amounts shown in Table I.

The by-product compounds obtained from all 17 experiments were mixed together and portions thereof were used as the starting materials for the several succeeding Examples.

TABLE I

| Starting Reagents | | | | Add'n | React'n. | React'n. | Recovered Products | | | | |
|---|---|---|---|---|---|---|---|---|---|---|---|
| Ex. No. | Tin Moles | $Bu_4NBr$ Moles | BuBr Moles | times Hours | times Hours | temp. °C. | Tin Moles | BuBr Moles | by-product g | $Bu_3SnBr$ Moles | $Bu_2SnBr_2$ Moles |
| 1 | 4.0 | 2.0 | 6.0 | 4 | 2 | 140 | 0.67 | 0.26 | 1439 | 1.23 | nil |
| 2 | 6.7 | 2.0 | 8.0 | 4 | 2 | 140 | 3.37 | 0.07 | 1348 | 2.15 | 0.31 |
| 3 | 6.7 | 2.0 | 8.0 | 4 | 2 | 140 | 1.9 | 0.09 | 1379 | 1.82 | 0.44 |
| 4 | 6.7 | 2.0 | 8.0 | 3 | 3 | 140 | 2.66 | 0.79 | 1253 | 1.70 | 0.41 |
| 5 | 6.7 | 2.0 | 8.0 | 5 | 4 | 120 | 3.08 | 1.21 | 1303 | 1.47 | 0.26 |
| 6 | 6.7 | 2.0 | 8.0 | 4.5 | 10 | 115-120 | 3.9 | 0.28 | 1281 | 1.37 | 0.48 |
| 7 | 6.7 | 2.0 | 8.0 | 3 | 3.5 | 140 | 2.0 | 0.11 | 1426 | 1.60 | 0.46 |
| 8 | 4.0 | 2.0 | 6.0 | 4 | 2 | 135-160 | 1.01 | 1.07 | 1342 | 0.78 | nil |
| 9 | 4.0 | 2.0 | 6.0 | 4 | 2 | 140-150 | 0.66 | 0.55 | 1291 | 1.31 | 0.07 |
| 10 | 5.0 | 2.0 | 6.0 | 4 | 2 | 145-160 | 1.61 | 0.24 | 1254 | 1.33 | nil |
| 11 | 5.0 | 2.0 | 6.0 | 4 | 2 | 130-135 | 3.06 | 0.64 | 1185 | 0.94 | nil |
| 12 | 4.0 | 2.0 | 6.0 | 4 | 2 | 120-125 | 1.47 | 1.50 | 1236 | 0.72 | nil |
| 13 | 4.0 | 2.0 | 6.0 | 4 | 6 | 120-130 | 1.23 | 0.48 | 1159 | 1.08 | nil |
| 14 | 4.0 | 2.0 | 7.0 | 4 | 4 | 120 | 1.45 | 1.64 | 1184 | 0.99 | nil |
| 15 | 4.0 | 2.0 | 8.0 | 4 | 4 | 120 | 0.95 | 2.9 | 1312 | 0.94 | nil |
| 16 | 5.0 | 2.0 | 8.0 | 4 | 4 | 120 | 1:90 | 2.6 | 1303 | 1.19 | nil |
| 17 | 6.0 | 2.0 | 8.0 | 4 | 4 | 120 | 2.3 | 1.19 | 1303 | 1.37 | nil |

EXAMPLE 1

Electrolysis and tin-enrichment of by-product, followed by conversion of tin-rich electrolysis product to organotin halides For the electrolysis of by-product there was used the double-anode cell illustrated in FIG. 1 of the accompanying drawings. This cell comprises a polypropylene tank 10, 40 cm×40 cm×25 cm, containing a stainless steel cathode 11, 35 cm×25 cm×0.3 cm connected to an insulated conductor 12. The cell was charged with the hydrocarbon-insoluble yellow-khaki halogenotin complex by-product obtained in the above preliminary preparations in sufficient amount to cover the floor of the cell with 9.83 kg of said byproduct. The by-product contained about 5% of the hydrocarbon (b.p. 145°-160°) used to extract the organotin products, and about 2% free $Bu_4NBr$.

Above the by-product phase 13 was placed 16 l. of 20% aqueous NaBr solution as intermediate electrolyte 14. Extending into intermediate electrolyte 14 was a chamber 15 covered by an ion-exchange membrane (Nafion TM available from duPont) containing therein as anolyte a solution 16 of 20% NaOH in which was placed a nickel anode 17. Also extending into the intermediate electrolyte 14 was a suspended tin anode 18 (weight 9.97 kg) with a feeder 19. The anodes 17 and 18 were connected to the positive terminal of a variable-power source of DC (not shown) and the cathode conductor 12 to the negative terminal thereof.

A current of approximately 100 amps was passed through the cell over a period of about 11 hours. During this time the cell voltage fell from an initial 20 V to a final value of 5 V and the cell temperature varied between 50° and 100°. The current carried by each anode was monitored and adjustments made (by disconnecting one or other anode) so that each anode carried approximately the same total number of amp-hrs.

At the end of the electrolysis the nickel anode had passed 550 amp-hrs, evolving oxygen, and the tin anode had passed 530 amp-hrs losing 1.1 kg of tin. Sodium bromide was formed in the intermediate electrolyte 14 and fine dendritic tin and the $Bu_4N^+Br^-$ were formed at the cathode 11. About 680 g of $Bu_4N^+{}^{Br}{}^-$ appeared in the electrolyte 14.

The final catholyte was a blackish, lumpy, mobile fluid (8.52 kg) which contained 9% water, about 25% $Bu_4N^+Br^-$, about 25% dendritic tin and about 41% of unreacted by-product.

Some of this final catholyte (6.17 kg) was transferred to a 10 liter flask fitted with anchor stirrer, condenser and dropping funnel and heated under vacuum to remove water. Over the course of four hours butyl bromide was added to this electrolysis product (which effectively contained about 1540 g, i.e., 13 moles of tin and 1550 g, i.e., 4.8 moles, of $Bu_4N^+Br^-$) through a funnel dipping below the surface of the reaction mass at such a rate that the temperature in the reactor stayed around 140° C. At the end of four hours, 2466 g (18 moles) of BuBr had been added. The reaction mix was then maintained at 140° C. for a further eight hours.

Excess BuBr was then distilled off (363 g) and the residue was cooled and extracted with hydrocarbon solvent (b.p. 145°–160°, using 3 liters of solvent in each of 3 extractions), leaving a yellow-khaki residue, (5.4 kg), containing some tin dendrites. The hydrocarbon extracts were combined and distilled yielding a product of b.p. 150°/10 mm. This product weighed 1894 g and contained 87% $Bu_3SnBr$ (4.46 mole) and 12% $Bu_2SnBr_2$ (0.57 mole). The molar ratio of the tributyltin bromide to the dibutyltin bromide was thus about 8:1, for a conversion rate of 89% (based on tin) or 95% (based on BuBr) to the desired material.

EXAMPLE 2

Electrolysis of by-product and recycle of the electrolytic products

Some of the water-insoluble yellow-khaki by-product obtained in the above preliminary preparation was next subjected to electrolysis in the apparatus shown in FIG. II of the accompanying drawings.

This cell shown in FIG. II comprises a polypropylene tank 20, 30 cm diameter, 40 cm high containing a stainless steel cathode 21, 15 cm×20 cm×0.16 cm connected to an insulated feeder 22. The anode 23 is a cylinder of tin (approx. 8 cm diameter and 17 cm long) weighing about 6 kg.

This cell was loaded with 6 kg of the by-product from the production of tributyltin bromide as catholyte 24.

Seven liters of 20% aqueous NaBr solution was added as the anolyte 25. The anode was connected to the positive terminal of a DC power supply, and the cathode to the negative, and a current of between 50 to 60 amps was passed until a total of 360 amp-hrs had been reached. The starting voltage was 20 volts and starting temperature 80°; at the end these values were 8 volts and 60°.

At the end of this electrolysis the tin anode had lost 770 g, and 770 g of fine dendritic tin had been formed at the cathode.

The tin anode 23 was then removed and the anode and anode compartment 30 shown in FIG. III was installed 31, 32, 33, 34; see description in Example 3). This cell was connected in the usual way to the DC power supply and a current of 50–70 amps passed until 288 amp-hrs had been reached.

Oxygen was evolved at the anode, sodium bromide formed in the aqueous intermediate layer and tin dendrites and $Bu_4N^+Br^-$ were formed in the catholyte 24.

The catholyte (5.07 kg) contained 2.18 kg unreacted halogenotin complex by-product, $Bu_4N^+Br^-$ (1.18 kg), dendritic tin (1.4 kg), and water (0.3 kg).

This electrolysis product, containing approximately 10% water, 25% fine dendritic tin, 25% $Bu_4N^+Br^-$ (3.9 mole) and 40% unreacted by-product, was heated in the flask described in Example 2 to remove the water.

Butyl bromide (2330 g, 17 moles) was next added over 7 hours, with stirring, such that the reaction temperature was maintained at 150°. The reaction mixture was cooled and extracted with hydrocarbon (b.p., 145°–160°, 3×3 liters) at 80°, leaving a yellow-khaki residue which contained some tin. The hydrocarbon extracts were distilled giving 1663 g of product, which had a b.p. of 150°/10 mm which analysed (by weight) as about 80% $Bu_3SnBr$ and 20% $Bu_2SnBr_2$.

EXAMPLE 3

Electrolysis of Halogenotin Complex By-Product

Some of the yellow-khaki by-product obtained from the above 17 experiments was also subjected to electrolysis in the apparatus illustrated in FIG. III of the accompanying drawings.

This cell comprises a polypropylene tank 20 30 cm diameter, 40 cm high containing a stainless steel cathode 21, 15 cm×20 cm×0.16 cm connected to an insulated feeder 22. The anode compartment 30 is a polypropylene tube 31 10 cm diameter with an ion exchange membrane 32 sealing the bottom. The anode is a stainless steel tube 33.

This cell was loaded with 6 kg of the halogenotin complex by-product as the catholyte 24.

Seven liters of 20% aqueous sodium bromide was loaded on top of the catholyte as intermediate electrolyte 25 and the anode compartment 30 was partially filled with 25% sodium hydroxide as anolyte 34.

A current of between 30 and 50 amps was then passed through the cell until 310 amp-hrs had been passed. Oxygen was evolved at the anode and tin was deposited on the cathode as fine dendrites. The final catholyte was a blackish lumpy mobile liquid (4.85 kg) containing $Bu_4NBr$ (1860 g), the dendritic tin (686 g), and residual halogenotin complex by-product (2300 g). Additional sodium bromide was also produced in the intermediate electrolyte.

This process may be represented thus:

$$Bu_4N^+SnBr_3^- + 2NaOH(+2F) \rightarrow Bu_4NBr + Sn^\circ + 2NaBr + 0.5\,O_2 + H_2O$$

EXAMPLE 4

The cell as used in Example 1 (FIG. I) was next used for the electrolysis of a synthetic halogenotin complex. Thus, tetrabutylammonium bromostannite ($Bu_4N^+SnBr_3^-$, prepared from $Bu_4N^+Br^-$ and $HSnBr_3$ solutions, 11 kg) was loaded into the cell as catholyte and the rest of the cell prepared as in Example 1.

A current ranging from 40 to 100 amps was passed into the cell over a period of 17 hours. During this time the temperature in the cell rose to 75°–85°, the cell voltage at the start was 19 volts, which declined to 5 volts at the end. During this time 596 amp-hrs were passed through the tin anode (18) resulting in a consumption of 1500 g of tin. 540 amp-hrs were passed through the nickel anode (17).

The combined anode currents–1136 amp-hrs–were passed through the cathode (11) and caused the deposition of fine dendritic tin particles (2513 g). Of this tin product, 1320 g were derived from the tin anode and 1193 g came from the catholyte (13). Thus, the final catholyte comprised dendritic tin (2513 g) tetrabutylammonium bromide (3238 g) and unreacted tetrabutylammonium bromostannite (5040 g).

EXAMPLE 5

Crude tributyltinbromide ($Bu_3SnBr$) containing up to 28% dibutyltin dibromide ($Bu_2SnBr_2$), and halogenotin complex by-product were prepared in a series of experiments. These involved heating tributylamine ($Bu_3N$) with the tin and adding butyl bromide (BuBr) at a rate which maintained the reaction temperature (130°–140°). When this addition was complete the reaction mass was maintained at 130°–140° for several hours. Excess BuBr was removed by distillation. After cooling to about 60°-80° the reaction liquor was decanted from the tin and extracted with 3 volumes of hydrocarbon (b.p. 145°-60°). The extracts were then combined and the hydrocarbon distilled leaving the crude $Bu_3Sn$-$Br$-$Bu_2SnBr_2$ mixture. The halogeno tin complex by-product remaining after extraction was heated under vacuum to remove any residual hydrocarbon and the product stored in plastic containers. The amounts of materials used and the products obtained are shown in Table II.

TABLE II

| Exp. No. | Starting Materials $Bu_3N$ Kg | Tin Kg | BuBr Kg | Tin* Kg | Products $Bu_3SnBr$ - $Bu_2SnBr_2$ Weight Kg | % $Bu_3SnBr$ | % $Bu_2SnBr^2$ | Halogenotin Complex By-product Kg |
|---|---|---|---|---|---|---|---|---|
| A | 1.85 | 2.37 | 5.56 | Trace | 2.87 | 89 | NA | 6.4 |
| B | 2.17 | 2.78 | 6.89 | — | 2.92 | 70 | 28 | 7.75 |
| C | 1.88 | 2.41 | 5.98 | — | 2.87 | NA | NA | 5.81 |
| D | 1.29 | 1.8 | 4.15 | 0.1 | 2.41 | 73 | 21 | 4.37 |
| E | 1.85 | 2.37 | 5.9 | 0.23 | 2.85 | 74 | 26 | 6.2 |
| F | 1.85 | 1.58 | 4.41 | 0.06 | 1.11 | NA | NA | 5.95 |
| G | 1.85 | 1.58 | 4.41 | 0.5 | 1.1 | NA | NA | 7.2 |

*Residual elemental tin
NA = Not Analyzed

These halogenotin complex by-products were electrolysed in a cell illustrated in FIG. IV. This cell has a polypropylene body 41 with a cross section of approximately 30 cm×30 cm and an overall height of approximately 45 cm. The cell has a polypropylene bottom valve 42 and is mounted on feet (not shown) so that the bottom inverted pyramidal part extends through a hole in the supporting platform. The cell is heated by external electrical heating tapes 43 and is insulated and clad 44. The cell has two further taps, 45 and 46, in its higher portion.

Internally the cell has two cathode plates 47 connected to cathode feeder lines 56. Above the cathodes there are two tin anodes 48 (one shown) mounted in mild steel feeders 58 which in turn are supported on insulated bushes on an anode support frame 49 which is screwed to the platform.

Alongside the tin anodes is a third anode 50 made of nickel. This nickel anode is supported on mild steel feeders 57 and held from the anode support frame. The nickel anode 50 is separated from the rest of the cell inside a compartment made up from outer clamping members 51, an inner member 52 and two ion exchange membranes 53. Parts 51 and 52 are U-shaped in section and are clamped together with bolts sandwiching the membranes 53 so that a five-sided compartment with an open top is formed.

The cell has two polypropylene scrapers 54, with blades, **54*a* which can be pushed across the top of the cathodes 47 to scrape and dislodge metal formed on the cathodes and allow this metal to fall into the bottom part of the cell (i.e., below the cathodes). The cell has an agitator on a shaft 55** connected to the motor (not shown). This agitator is used to stir the bottom phase containing such metal particles.

In operation the tin anode feeders 58 and the right-hand cathode feeder 56 are connected to one rectifier (not shown) and the nickel anode feeder 57 and the left-hand cathode feeder 56 are connected to another rectifier. The tin anodes can be adjusted up and down on their feeders 58.

The cell was loaded with 25.9 kg of mixed halogenotin complex by-product from Table II, and 16 liters of 10% wt/volume sodium bromide solution. This resulted in a two-phase system with the halogenotin complex below the aqueous solution and with the interface therebetween about 1 cm above the cathode plates 47. Aqueous sodium hydroxide (25%, 2 l.) was poured into the anode compartment formed by 51, 52 and 53. The cell contents were heated to 75°-95° and current passed from both rectifiers. A total of 1103 amp-hrs was passed through the nickel anode and 1163 amp-hrs through the tin anodes. Currents ranging from 5 to 150 amps (aqueous-nonaqueous interfacial current densities of 5.5 $mA/cm^2$ to 167 $mA/cm^2$ respectively) were passed during this electrolysis and the relative currents passed through the tin anodes and the nickel anode were adjusted to give approximately the same number of coulombs through each anode system. The starting cell voltage was about 20 volts and this declined during the electrolysis to about 8-10 volts.

The electrolysis products were 17.7 liters of 30% wt/volume sodium bromide solution and 24 kg of a mixture of $Bu_4N^+Br^-$-dendritic tin-halogenotin by-product. The tin anodes had lost a total of 2.57 kg of tin. About 1 kg of the bottom phase was removed and a further 4 kg of by-product from above added. Most of the aqueous phase was removed via tap 45 and water added to the remainder to dilute the sodium bromide solution to approximately 10%. A further 924 amp-hrs were passed through the tin anodes resulting in a loss therefrom of 1.89 kg tin, and a further 844 amp-hrs were passed through the nickel anode.

The bottom phase was run off through valve 42 and analysed. Analysis indicated that this phase contained 23.4% dendritic tin and 28% $Bu_4NBr$ and about 1% water, its total weight was 26.5 kg. 9.3 kg of this material was separately heated under vacuum to remove the water and a total of 4.3 kg butyl bromide added while heating between 100° and 150°. The excess butyl bromide was distilled and the reaction mass extracted with hydrocarbon spirits (b.p. 145°-160°). Distillation of the hydrocarbon extracts give a crude product (2.79 kg) analysing as 86% $Bu_3SnBr$ and 14% $Bu_2SnBr_2$. The residue, after extraction, was a water-insoluble halogenotin complex (8.3 kg) and dendritic tin (0.9 kg).

EXAMPLE 6

The cell as just described in Example 5 was next loaded with 14.3 kg of the bottom phase from the electrolysis in Example 5, 10.6 kg of the combined halogenotin complex by-products from Example 5 (Table II), and 16 liters of 9.5% sodium bromide solution. 2.5 liters of 25% sodium hydroxide was loaded into the membraned nickel anode compartment. A total of 342 amp-hrs were passed through the tin anodes and 452 amp-hrs through the nickel anode.

The cell was operated at approximately 100 amps (interfacial current density 111 mA/cm$^2$) with about 50 amps on each anode system.

The bottom phase (23 kg) was then drawn off and treated in two portions to remove water (625 gm) and reacted with butyl bromide (total 5.36 kg) at 110° to 150°. The excess butyl bromide was then distilled under vacuum and the residue extracted with hydrocarbon. The hydrocarbon extractant was distilled off leaving a residue of crude $Bu_3SnBr$ (total 2.0 kg) which, analysed by Gas Liquid Chromatography (GLC), was mainly $Bu_3SnBr$. The total residue after extraction amounted to 18.8 kg, with about 1 kg of unreacted tin.

EXAMPLE 7

The halogenotin and butyltin halogeno complex residues from Examples 5 and 6 were now combined and loaded into the cell as described in Example 5 (FIG. IV) with 16 liters of 8% aqueous sodium bromide solution as the upper phase. Two liters of 25% aqueous sodium hydroxide were loaded into the nickel anode compartment. This three electrolyte system was electrolysed at 75°-100°, with a combined current of about 100 amps at a voltage of 10-20 volts. A total of 1181 amp-hrs were passed through the tin anodes and 1180 amp-hrs through the nickel anode. The bottom phase was analysed and found to contain approximately 10% dendritic tin, 20% $Bu_4N^+Br^-$ and 4% water, the balance being the complex by-product.

About 20 kg of this bottom layer were converted to butylated tin products in three experiments by removing the water under vacuum and adding butyl bromide at 150°-155° over 5-6 hours. The excess butyl bromide was removed under vacuum and the organotin extracted with three volumes of hydrocarbon, followed by distilling the extracts. This procedure leaves the halogenotin complex as an insoluble residue. The details are given in Table III.

The electrolysis cell was an 800 ml squatform beaker with a flat stainless steel disc (9 cm diameter) on the bottom as a cathode. The disc had a 6 mm stainless steel rod welded at right angles to it at the circumference; this acted as a cathode feed and was insulated with rubber tubing from the disc to within 2 cm of its top. A cylinder of tin (approximately 6 cm diameter and 6 cm long) held on a 6 mm stainless steel rod was used as the anode in the first part of the electrolysis (as in FIG. II). In the second part of the electrolysis, an anode compartment was used; this was made from a piece of 2.5 cm diameter polypropylene tube closed at the bottom by an ion exchange membrane. The compartment contained a nickel anode and was generally similar to the anode compartment shown in FIG. III. In use the cell was heated by a water bath and the cathode connected to the negative terminal of a DC supply with the anode connected to the positive terminal.

241 g of the hydrocarbon insoluble residue from above was poured into this cell and on top of this was poured 10% aqueous sodium bromide solution (336 g). The residue, which was non-aqueous, was not soluble in the aqueous phase and formed the lower phase in the cell becoming the catholyte. The tin anode was inserted into the aqueous phase, the cell heated to 70°, and a current of approximately 5 amps at about 4 volts was passed until 7.9 amp-hrs had been reached. This resulted in a loss of 17.6 g from the tin anode and the formation of dendritic tin in the non-aqueous bottom phase. The tin anode was then removed and the nickel anode in its polypropylene compartment filled with 25% sodium hydroxide solution, was inserted into the aqueous phase. A current of about 3 amps at about 16 volts was passed until 5.4 amp-hrs had been reached. The cell was then taken apart and the non-aqueous bottom phase dissolved in acetone and filtered. The residue was washed with acetone and dried, leaving 31.2 g of dendritic tin. The acetone solution was distilled off under vacuum

TABLE III

| | Starting Materials | | | Products $Bu_3SnBr$ and $Bu_2SnBr_2$ | | | |
|---|---|---|---|---|---|---|---|
| Exp. No. | Cell bottom phase Kg | BuBr Kg | Elemental Tin Kg | Weight Kg | % $Bu_3SnBr$ | % $Bu_2SnBr_2$ | Halogenotin Complex By-product, Kg |
| A | 6.4 (after drying) | 2.3 | 0 | 1.74 | 71 | 26 | 6.3 |
| B | 6.56 | 1.68 | .33 | 1.67 | 84 | 7 | 6.9 |
| C | 7.6 | 1.81 | .19 | 1.51 | 85 | 15 | 7.66 |
| Totals | 20.56 | 5.79 | 0.52 | 4.92 | 79.7 | 16.2 | 20.86 |

EXAMPLE 8

Granulated tin (118.7 g, 1 mole) and tetrabutylammonium bromide ($Bu_4N^+Br^-$, 161 g, 0.5 mole) were heated to 130°-145° in a flask fitted with a condenser thermometer and dropping funnel. Butyl chloride (138.7 g, 1.5 mole) was added slowly so that the temperature remained at 130°-145°; this took about 60 hours. After this time the reaction mass weighed 397 g. The liquor was decanted from the unreacted tin and the tin washed with acetone and dried leaving a residue of 39 g of tin. The decanted liquor (342 g) was then extracted with hydrocarbon (b.p. 145°-160°, 2 ×400 ml) to extract the organotin, leaving a hydrocarbon insoluble residue (281 g) which analysed at 23.3% tin, 12.1% bromine and 12.6% chlorine. This residue was treated by electrolysis as described below.

leaving a non-aqueous halogenotin residue. The tin content of this residue had been reduced to 20% by the electrolysis. In this example, dendritic tin was thus produced from the tin anode and from the complex catholyte.

EXAMPLE 9

(Using octyl bromide)

Granulated tin (118.7 g, 1 mole) and $Bu_4N^+Br^-$ (161 g, 0.5 mole) were heated to 140°-150° in a flask fitted with a condenser, thermometer and dropping funnel. Octyl bromide (289.6 g, 1.5 mole) was added from the dropping funnel over 9 hours keeping the temperature at 140°-150°; the reaction mass was heated for a further 32 hours. After this time the reaction mass weighed 565.6 g. The liquor was decanted from the unreacted tin and the tin washed with acetone and dried, leaving a residue of 19.1 g of tin. The decanted liquor (536.7 g) was in two layers and these were separated. The bottom layer was extracted with hydrocarbon to remove the organotin (b.p. 145°–160°, 2×200 ml) leaving a hydrocarbon insoluble residue (340.3 g) which analysed at 20.3% tin and 33% bromine.

251 g of this residue was poured into the cell described in Example 8 and on top of this was poured 10% aqueous sodium bromide solution (358 g). The residue which was non-aqueous, was not soluble in the aqueous phase, and formed the lower phase in the cell, becoming the catholyte. The tin anode was inserted into the aqueous phase, the cell heated to 70°, and a current of approximately 5 amps at 2–5 volts passed until 7 amp-hrs had been reached. This resulted in a loss of 14.6 g from the tin anode and the formation of dendritic tin in the non-aqueous bottom phase. The tin anode was removed and the nickel anode in its polypropylene compartment filled with 25% sodium hydroxide solution, as in Example 8, was inserted into the aqueous phase. A current of about 3 amps at 12–16 volts was passed until 5.77 amp-hrs had been reached. The cell was taken apart and the non-aqueous bottom phase dissolved in acetone and filtered. The filtration residue was washed with acetone and dried leaving 30.1 g of dendritic tin. The acetone solution was distilled under vacuum leaving a non-aqueous halogenotin residue. The tin content of this residue had been reduced to 16.7% by the electrolysis.

EXAMPLE 10

(Using propyl bromide)

Granulated tin (118.7 g, 1 mole) and tetrabutylammonium bromide (161 g, 0.5 mole) were heated to 140°–150°, in a flask fitted with a condenser, thermometer and dropping funnel. Propyl bromide (184.5 g, 1.5 mole) was added from the dropping funnel while maintaining the temperature at about 140°, taking about 15 hours. The reaction mass was kept at 140°, for approximately 40 hours after which time it weighed 434 g. The liquor was decanted from the unreacted tin which was washed with acetone and dried leaving a residue of 16 g of tin. The decanted liquor was extracted twice with its own volume of hydrocarbon (b.p. 145°–160°) to remove the organotin leaving a hydrocarbon insoluble residue (293 g) which analysed at 23.5% tin and 39.2% bromine.

242 g of this residue was poured into the cell described in Example 8 and 10% aqueous sodium bromide solution (312 g) was poured on top. The residue, which was non-aqueous, was not soluble in the aqueous phase, and formed the lower phase in the cell, becoming the catholyte. The tin anode was inserted into the aqueous phase, the cell heated to 60°–70°, and a current of approximately 5 amps at 1–10 volts passed until 5.6 amp-hrs had been reached. This resulted in a loss of 7 g from the tin anode and the formation of dendritic tin in the non-aqueous bottom phase. The tin anode was removed and the nickel anode-sodium hydroxide solution-polypropylene compartment was inserted into the aqueous phase, as in Example 8. A current of about 3 amps at 9–12 volts was passed until 5.6 amp-hrs had been reached. The cell was taken apart and the non-aqueous bottom phase dissolved in acetone and filtered. The filtration residue was washed with acetone and dried leaving 21.2 g of dendritic tin. The acetone solution was distilled under vacuum leaving a non-aqueous halogenotin residue. The tin content of this residue had been reduced to 18% by the electrolysis.

EXAMPLE 11

Granulated tin (79 g, 0.67 mole) $Bu_4N^+Br^-$ (107 g, 0.34 mole), tetrabutylammonium bromostannite ($Bu_4N^+SnBr_3^-$ prepared from $Bu_4N^+Br^-$ and aqueous $HSnBr_3$, 200 g, 0.34 mole), copper powder (0.4 g, 0.006 mole) were heated to 140°–150°, in a flask fitted with a condenser, thermometer and dropping funnel. Butyl bromide (137 g, 1 mole) was added from the dropping funnel over 2.5 hours keeping the temperature at about 140°. Heating was continued for a further 72 hours by which time the reaction mass weighed 517 g. The liquor was decanted from the unreacted tin and the tin washed with acetone and dried, leaving a residue of 9.1 g of tin. The decanted liquor (494 g) was extracted twice with its own volume of hydrocarbon (b.p. 145°–160°) to remove the organotin leaving a hydrocarbon insoluble residue (425 g) which analysed at 17.15% tin and 37% bromine.

268 g of this residue was poured into the cell described in Example 8 and 10% aqueous sodium bromide solution (324 g) poured on top. The residue, which was non-aqueous, was not miscible with the aqueous phase, and formed the lower phase in the cell, becoming the catholyte. The tin anode was inserted into the aqueous phase, the cell heated to 60°–70°, and a current of about 4 amps at 8–11 volts passed until 3.9 amp-hrs had been reached. This resulted in a loss of 8.7 g from the tin anode and the formation of dendritic tin in the non-aqueous bottom phase. The tin anode was replaced by the nickel anode system, as in Example 8, and a current of 3 amps at 10 volts passed until 3.9 amp-hrs had been reached. The cell was taken apart and the bottom phase dissolved in acetone and filtered. The filtration residue was washed with acetone and dried leaving 14.5 g of dendritic tin.

EXAMPLE 12

(Using butyl triphenyl phosphonium bromide)

Granulated tin (95 g, 0.8 mole) butyltriphenyl phosphonium bromide (80 g, 0.2 mole), butyl bromide (82 g, 0.6 mole) and dimethyl formamide (105 g) were heated in a flask (fitted with a condenser and thermometer) to 150°–155° for approximately 40 hours. After this time the reaction mass weighed 349 g. The liquor was decanted from the unreacted tin and the tin washed with acetone and dried, leaving a residue of 58.4 g of tin. The decanted liquor (283 g) was heated in a rotary evaporator under vacuum leaving a liquid residue weighing 186 g.

180 g of this material was extracted with hydrocarbon (b.p. 145°–160°, 2×150 ml) to remove the organotin, leaving a hydrocarbon insoluble residue (156 g) which analysed at 20% tin, and 30.4% bromine.

110 g of this residue was poured into the cell described in Example 8 and 10% aqueous sodium bromide solution (321 g) poured on top. The residue, which was non-aqueous, was not miscible with the aqueous phase and formed the lower phase in the cell becoming the catholyte. The tin anode was inserted into the aqueous phase, the cell heated to 60°–70°, and a current of about 5 amps at 2–14 volts passed until 2 amp-hrs had been reached. This resulted in a loss of 4.7 g from the tin anode and the plating of tin on the cathode in the non-aqueous bottom phase. The tin anode was replaced by the nickel anode system and a current of about 2 amps at 10–15 volts passed until 2 amp-hrs had been reached. The cell was taken apart and the plated tin scraped from the cathode, amounting to 15.4 g. The bottom phase was dried and analysed at 14.9% tin.

EXAMPLE 13

(Using triphenyl phosphine)

Granulated tin (237.4 g, 2 mole) triphenyl phosphine (131 gm, 0.5 mole) and dimethyl formamide (160 g) were heated to 140°–150° in a flask fitted with a condenser, thermometer and dropping funnel. Butyl bromide (274.5 g, 2 mole) was added from the dropping funnel while maintaining the temperature at about 140°. The reaction mass was kept at 140° for approximately 30 hours after which time it weighed 765 g. The liquor was decanted from the unreacted tin which was then washed with acetone and dried leaving a residue of 138.3 g of tin. The decanted liquor (618.5 g) was distilled under vacuum in a rotary evaporator leaving a liquid residue weighing 476 g. This was extracted with hydrocarbon (b.p. 145°–160°, 2×400 ml) to remove the organotin leaving a hydrocarbon insoluble residue (368.5 g) which analysed at 21% tin and 34.8% bromine.

200 g of this halogenotin residue was poured into the cell described in Example 8 and 10% aqueous sodium bromide solution (322 g) poured on top. The halogenotin residue was not miscible with the aqueous phase and formed the lower phase in the cell covering the cathode, becoming the catholyte. The tin anode was inserted into the aqueous phase, the cell heated to 60°–70°, and a current of about 3 amps at 2–13 volts passed until 3.7 amp-hrs had been reached. This resulted in the tin anode losing 8.2 g and the formation of dendritic tin on the cathode in the non-aqueous bottom phase. The tin anode was replaced by the nickel anode system, as in Example 8, and a current of about 3 amps at 9–15 volts passed until 3.8 amp-hrs had been reached. The cell was taken apart and the bottom phase dissolved in acetone and filtered. The filtration residue was washed with acetone and dried leaving 25.7 g of coarse dendritic tin. The acetone solution was distilled leaving a non-aqueous halogenotin residue analysing at 14% tin.

EXAMPLE 14

(Using butyl iodide)

Granulated tin (43 g, 0.36 mole) and $Bu_4N^+Br^-$ (58.4 g, 0.18 mole) were heated to 140°–150°, in a flask fitted with a condenser, thermometer and dropping funnel. Butyl iodide (100 g, 0.54 mole) was added over 2.5 hours keeping the temperature at 140°–150°; the reaction mass was heated for a further 16 hours. After this time the reaction mass weighed 196.8 g. The liquor was decanted from the unreacted tin and the tin washed with acetone and dried leaving a residue of 5.7 g of tin. The decanted liquor (185 g) was extracted with hydrocarbon (b.p. 145°–160°, 2×200 ml) to remove the organotin, leaving a hydrocarbon insoluble residue (124 g) which analysed at 16.8% tin, 29.6% iodine and 7.9% bromine.

101 g of this bromoiodotin complex residue was poured into the cell described in Example 8 and 10% aqueous sodium bromide solution (360 g) poured on top. Again the halogenotin complex was not miscible with the aqueous phase and formed the lower phase in the cell covering the cathode and becoming the catholyte. The tin anode was dipped into the aqueous phase, the cell heated to 60°–70°, and a current of about 3 amps at 8–12 volts passed until 1.5 amp-hrs had been reached. This resulted in a loss of 3.5 g from the tin anode and the deposition of tin on the cathode in the non-aqueous bottom phase.

The tin anode was replaced by the nickel anode system, as in Example 8, and a current of about 3 amps at 14 volts passed until 1.5 amp-hrs had been reached. The cell was taken apart and the bottom phase dissolved in acetone and filtered. The filtration residue combined with the tin scraped from the cathode and washed with acetone and dried leaving 2.4 g of tin. The acetone solution was distilled leaving a non-aqueous halogenotin residue analysing at 13.5% tin.

EXAMPLE 15

(Using tetraoctyl ammonium bromide and octyl bromide)

Granulated tin (19.5 g, 0.16 mole) tetraoctylammonium bromide (45 g, 0.08 mole) and octyl bromide (47.6 g, 0.24 mole) were heated to 140°–150°, for approximately 20 hours in a flask fitted with a thermometer and condenser. After this time the reaction mass weighed 112 g. The liquor was decanted from the unreacted tin and this tin washed with acetone and dried, leaving a residue of 2.7 g of tin. The decanted liquor was extracted with hydrocarbon (b.p. 145°–160°, 2×100 ml) to remove the organotin, leaving a hydrocarbon insoluble residue (103 g) which analysed at 14% tin and 22.2% bromine.

70 g of this halogenotin residue was poured into the cell described in Example 8 and 10% aqueous sodium bromide solution (312 g) poured on top. Again the halogenotin complex was not miscible with the aqueous phase and formed the lower phase in the cell covering the cathode and becoming the catholyte. The tin anode was inserted into the aqueous phase, the cell heated to 60°–70°, and a current of about 1 amp at 20 volts passed until 1.1 amp-hrs had been reached. This caused the loss of 1.6 g from the tin anode and the deposition of tin on the cathode in the non-aqueous lower phase. The tin anode was replaced by the nickel anode system, as in Example 8, and a current of 2 amps at 14 volts passed until 0.9 amp-hrs had been reached. The cell was taken apart and the bottom phase dissolved in acetone and filtered. The filtration residue, after washing and drying, was in two parts: dendritic tin (0.7 g) and small hard amber colored particles (2 g). The acetone solution was distilled leaving a residue containing 11.7% tin. The aqueous sodium bromide solution from the first part of the electrolysis (285 g) contained 0.37% tin.

EXAMPLE 16

(Using stearyl bromide)

Granulated tin (79 g, 0.67 mole), tetrabutylammonium bromide (107 g, 0.33 mole) and stearyl bromide ($C_{18}H_{37}Br$, 333 g, 1 mole) were heated to 140°–150°, in a flask fitted with a condenser and thermometer for about 100 hrs. The liquor (which was two phases) was decanted from the unreacted tin which was then washed with acetone and dried, leaving a residue of 14.5 g of tin. The decanted liquor was separated into two phases, the top layer (121 g) analysed at 9% tin. The bottom layer was extracted twice with its own volume of hydrocarbon (b.p. 145°–160°) to remove any organotin, leaving a hydrocarbon insoluble residue (288 g) which analysed at 16.8% tin and 27.7% bromine.

141 g of this halogenotin residue was poured into the cell described in Example 8 and 10% aqueous sodium bromide solution (334 g) poured on top. The halogenotin complex was not miscible with the aqueous phase and formed the lower phase in the cell covering the cathode, becoming the catholyte. The tin anode was inserted into the aqueous phase, the cell heated to 60°–70°, and a current of about 2 amps at 6–20 volts passed until 2.2 amp-hrs had been reached. This caused the loss of 3.9 g from the tin anode and the deposition of dendritic tin on the cathode in the non-aqueous lower phase. The tin anode was replaced by the nickel anode system, as in Example 8, and a current of about 3 amps at 11–20 volts passed until 2.2 amp-hrs had been passed. The cell was taken apart and the bottom phase dissolved in acetone and filtered. The filtration residue was washed with acetone and dried leaving 8.4 g of dendritic tin. The acetone solution was distilled giving a residue containing 13.1% tin.

EXAMPLE 17

A portion of the combined halogenotin by-products from Table III of Example 7 (1011 g) was poured into the cell described in Example 8. 10% aqueous sodium bromide solution (763 g) was poured on top and the tin anode inserted into the top aqueous phase. The cell was heated to 60°–70°, and a current of about 6 amps at 4–14 volts passed until 58.9 amp-hrs had been passed. This resulted in the loss of 114 g from the tin anode and the deposition of dendritic tin on the cathode in the bottom phase. The cell was taken apart and the bottom phase (dendritic tin and halogenotin by-product) transferred to a reaction flask fitted with a condenser, thermometer, dropping funnel and anchor stirrer. The flask was heated under vacuum to remove water and then heated to 125°–140°, while butyl bromide (263 g) was slowly added. This addition took 2 hours and the mixture was heated for a further 3 hours. The reaction mass was extracted twice with its own volume of hydrocarbon (b.p. 145°–160°) leaving a hydrocarbon-insoluble residue weighing 1015 g. The hydrocarbon extracts were combined and distilled leaving an organotin product, which analysed by GLC as 68% dibutyl tin dibromide and 35% tributyltin bromide.

COMPARATIVE EXAMPLE A (Absence of two-phase system)

A 540 g portion of the combined halogentin by-product from Table III of Example 7 was poured into a 600 ml beaker and heated in a water bath to 70°–80°. Two tin rods, 15 cm×1 cm diameter, were dipped into the molten halogenotin so that 5 cm of each was immersed and they were 1.2 cm apart. One tin rod was connected to the positive terminal of a DC power supply, the other to the negative terminal and 18–20 volts applied. A resulting very small current of 5 to 9 mA was passed for about 1.5 hours. Since the working part of each electrode is about 8 $cm^2$, the resulting current density was also very low at about 1 $mA/cm^2$. This low current density under single phase electrolysis conditions is due to the low electrical conductivity of the halogenotin complexes and should be contrasted with the very much higher (up to 200 time higher) interfacial current densities obtained in the two-phase electrolyses described hereinabove. This technique is economically unfeasible.

COMPARATIVE EXAMPLE B (Cathode in both phases)

Another 540 g portion of the combined halogenotin by-product from Table III of Example 7 was poured into a 600 ml beaker. 10% aqueous sodium bromide solution (185 g) containing stannous chloride (9 g) was poured on top and the beaker heated to 80° in a water bath. One tin rod 15 cm×1 cm diameter was dipped into the top aqueous phase so that 2.5 cm was immersed; this was connected to the positive terminal of the DC power supply. A second tin rod, 15 cm×1 cm diameter, was dipped into the beaker 4 cm from the first. This rod was lowered further into the twophase system so that 3 cm thereof was immersed in the bottom, halogenotin phase and 3.5 cm was in the upper, aqueous phase; this was connected to the negative terminal. A current of 1–2 amps at 1–5 volts was then passed until 1.36 amp-hrs had been reached. 2.5 g of tin was lost from the tin anode (immersed in the aqueous phase only), but dendritic tin had been deposited only on that part of the cathode which was in the aqueous phase. There was no indication of deposition on the lower part of that cathode which had extended into the lower halogenotin complex phase, which phase appeared unchanged.

Additional Apparatus Embodiment

While the cell illustrated in FIG. IV was used for many of the above examples, as indicated therein, for larger production purposes the cell construction illustrated in FIGS. VI, VII and VIII is preferred.

FIG. VI illustrates in cross section a 2000 ampere cell which would be equipped with conventional rectifiers and controls, etc. (not shown). In general, the construction of this cell is analogous to that of FIG. IV. However, the polypropylene body 60 is in this instance supported by a mild steel casing 61 which sits in turn on load cells 62 (only one shown) which are held on a supporting platform. In common with the FIG. IV apparatus, steel supporting structures 63 hold two tin anodes 64 (one shown) and the drive motor 65. This agitator drive may be a variable DC motor coupled at 66 to the shaft 67 which drives the lower agitator blades 68 and scraper blades 69. The upper parts of the scraper blades also serve as an agitator for the upper phase. The combined agitator and scraper blades 69 serve a dual purpose of creating upward flow movement of the halogenotin complex to replace electrolyzed material at the liquid-liquid interface, while also dislodging deposited metal from the cathode surface.

The conical bottom of the cell is fitted with a push-up-type valve 70 at the bottom of the cone to permit removal of metal dendrites and/or electrolyte from the cell. The push-up valve is useful in the event unstirred dendritic metal settles to form a crust, as this can then be broken open to allow drainage of the lower phase.

Each tin anode 64 may weigh 100 to 200 kg at start-up, and are held on a threaded steel rod 71 supported on an insulated bushing structure 72, respectively connected to feeder cables 79. By this means the vertical position of the anodes can be adjusted up and down. The nickel anode compartment is shown as 73 and is simply a polypropylene box with an open top, and a bottom closed by an ion exchange membrane having suitable supports and seals. This anode chamber may be supported from the mild steel casing 61 by suitable steel work 74, and the chamber is fitted with a nickel anode (not shown) connected to feeder cable 75.

The cathode plates 74 are here two semicircles of stainless steel supported on suitable polypropylene lugs within the cell and connected to the cathode cables 78 (see FIG. VIII). Suitable plate heater 80 may be hung underneath the cathode plates. A cooling coil 76 is also arranged within the cell, and the water-immiscible catholyte phase interface with the aqueous anolyte solution may be approximately 1 cm above the level of the cathode plates although this level can vary according to most efficient operation of a given device. During full operation at 2,000 amps and approximately 10 volts, the cooling coil 76 should be capable of removing approximately 20 kW.

FIG. VIII is partly broken away to show the space or gap 77 between the cathode plates to permit dendritic metal particles to fall through to the lower conical section of the cell, as the same are dislodged by the scraper blades. This gap may be approximately 2 cm wide, and additionally a spacing of approximately 0.5 cm clearance is maintained between the circumference of the cathode plates and the polypropylene cell body. In operation of this cell in combination with a reactor for production of tributyltin bromide, the capacity of the cell can be designed to receive some 450 kg of the halogenotin complex by-product, approximately 500 liters of 10% sodium bromide solution and approximately 100 liters of 25% sodium hydroxide solution for the nickel anode compartment 73, all to be heated with constant agitation to about 70°–80 °.

As already described above, the overall reaction for 50% conversion requires 4 Faradays, and inasmuch as 450 kg of the catholyte is approximately 750 moles, a current load of approximately 1,500 Faradays is required for the two anode-cathode electrolysis reaction, or some 40,200 amp-hrs, i.e., about 20 hours running time at 2,000 amps. Dendritic tin production can be expected to be a little under 90 kg with by-product production as follows:

$Bu_4NBr$ about 120 kg

NaBr about 77 kg and sodium hydroxide usage of about 30 kg, with a loss of tin from the tin anodes of a little more than 44 kg; total production of dendritic tin would be about 90 kg with about 44 kg coming from the halogenotin complex.

This embodiment is well sized for integration with an overall reaction combination as illustrated in the flow sheet of FIG. IV.

As will be appreciated, this invention is not limited to any of the specific embodiments shown, which are presented herein for purposes of illustrating the overall principles, and presently preferred arrangements, for practicing the invention. In any given apparatus set-up, and design, there will be a variation in the conditions employed to optimize performance of the process. Thus, the relative volumes of the catholyte and anolyte may be suitably varied in actual practice, as well as their respective concentrations of components. For instance, so long as the aqueous anolyte layer has a suitable salt concentration to supply the required anions and conductivity, it is not critical exactly what that concentration is. Similarly, the size and shape of the corrodible tin anodes is a matter of choice, to be determined in part by the desired products, and in part by the dimension and configuration of the actual electrolytic cell employed.

Further, so long as the catholyte is in a liquid state (i.e., at a temperature above its melting point, but below its decomposition point) the cell will function, more or less at optimum conditions depending upon the specific apparatus used. The concentration of sodium hydroxide and the dimensions of the anode in the separate anode compartment are again matters to be determined in a given system and may be varied considerably, with routine test runs establishing the optimum reaction conditions.

Again, as to temperature, the same should not be so high as to create a problem of evaporation of the open top of the electrolytic cell, unless the operator desires to take precautions to compensate for such evaporation.

As already described above, current loads to the given electrodes may be varied according to the product mix ultimately desired, and the overall current load can also be varied according to the desired overall time of reaction and an obvious calculation of economics in operating a given system.

Further, as indicated in the various examples hereinabove, a wide variety of reactant components may be employed. Thus, any of the halogens, chlorine, bromine or iodine, may be used in the formation of the halogenotin complexes, and similarly various organic radicals may be employed as "R" in the reactants used, as desired. The only essential requirement is that the organo "R" group be essentially inert to the electrolytic system, and yet suitable for the formation of a stable complex. Also, while the various Examples hereinabove generally use quaternary or ternary reagents, as previously indicated there may be used instead an alkali metal or alkaline earth metal ion complex with a poly-oxygen compound with similar functions and results.

Sodium hydroxide is obviously an alkali of choice, due to its economy, but in principle, other alkalis or anolyte solutions may be used in the separate anolyte compartment employed in the embodiments illustrated in any of FIGS. I, III, IV or VI–VIII. Similarly, materials for construction of the anodes and cathodes may be varied and are a matter of choice, and those skilled in the art will appreciate that the essential requirement here is basically appropriate electrolytic conductivity and corrosion resistance to the electrolyte medium employed. Likewise, the construction of the cell is a matter of merely suitable selection of stable materials which will withstand the conditions of the reaction.

Accordingly, the invention described herein is limited only by the spirit and scope of the following claims.

What we claim is:

1. An electrolytic method for the separate recovery of elemental tin and of an organic 'onium compound of the formula $Cat^+X^-$ from a water-insoluble $Cat^+$ halogenotin complex produced as a by-product in the manufacture of organotin halides by the direct reaction of tin with an organic halide in the presence of said $Cat^+X^-$ compound, wherein $Cat^+$ represents a positively-charged organic cation and $X^-$ represents an inorganic anion, which method comprises passing an electric current through an electrolyte system between an anode which is solely in contact with an aqueous anolyte and a cathode which is solely in contact with a water immiscible catholyte containing said water-insoluble complex.

2. A method according to claim 1 in which said anode is a non-corrodible anode and said anolyte is an alkali metal halide solution in water.

3. A method according to claim 1 in which said anode is formed of a corrodible metal and said anolyte is an aqueous alkali metal halide solution.

4. A method according to claim 1 in which said anode is a non-corrodible anode and said anolyte is an alkali metal hydroxide separated by an ion exchange membrane from a further intermediate electrolyte which is an alkali metal halide solution in water.

5. A method according to claim 4 wherein a current is also passed through a-second anode formed of a corrodible metal, and solely in contact with said intermediate electrolyte, whereby a product enriched in said corrodible metal is recovered.

6. A method as in claim 5 wherein said corrodible metal is tin or an alloy of tin.

7. A method according to claim 5 wherein said corrodible metal is deposited on said cathode in dendritic form.

8. A method as in claim 7 wherein said corrodible metal is tin or an alloy of tin.

9. A method of claim 1 wherein Cat+ has the general formula $R_zQ^+$ wherein each R group is independently an organic group, Q may be N, P, As or Sb, in which case z is 4, or Q may be S or Se, in which case z is 3.

10. The method according to claim 9 wherein R represents a hydrocarbyl radical of up to 20 carbon atoms selected from alkyl, cycloalkyl, aryl, aralkyl, alkenyl and aralkenyl groups.

11. The method of claim 1 wherein $X^-$ represents chloride, bromide or iodide.

12. The method of claim 1 wherein Cat+ represents a complex of an alkali metal ion or alkaline earth metal ion of the class of diglyme, polyoxyalkylene glycol, glycol ether, or crown ether.

13. The method according to claim 1 wherein a non-corrodible anode and a corrodible tin anode are both employed, both solely in contact with said aqueous anolyte, which anolyte is an alkali metal bromide solution;

whereby said passage of current causes corrosion of tin from said tin anode into the aqueous phase, and the transfer of tin ions across the interfacial boundary between the two immiscible electrolytes, and the deposition of elemental tin at the cathode, while simultaneously the electrolysis also causes evolution of bromine at said non-corrodible anode, the decomposition of the halogeno tin complex in the non-aqueous phase, and the transfer of bromide ions across the interfacial boundary from the non-aqueous phase into the aqueous phase.

* * * * *